US009359791B2

(12) United States Patent
Zhang

(10) Patent No.: US 9,359,791 B2
(45) Date of Patent: Jun. 7, 2016

(54) REKEYABLE LOCK ASSEMBLY WITH BLOWN CYLINDER PROTECTION

(71) Applicant: KWIKSET CORPORATION, Lake Forest, CA (US)

(72) Inventor: Jack Zhang, Xiamen (CN)

(73) Assignee: Kwikset Corporation, Lake Forest, CA (US)

( * ) Notice: Subject to any disclaimer, the term of this patent is extended or adjusted under 35 U.S.C. 154(b) by 0 days.

(21) Appl. No.: 14/055,470

(22) Filed: Oct. 16, 2013

(65) Prior Publication Data

US 2014/0041429 A1 Feb. 13, 2014

Related U.S. Application Data

(63) Continuation of application No. 12/543,456, filed on Aug. 18, 2009, now abandoned.

(51) Int. Cl.

| | |
|---|---|
| ***E05B 29/04*** | (2006.01) |
| ***E05B 27/00*** | (2006.01) |
| ***E05B 29/00*** | (2006.01) |

(52) U.S. Cl.

CPC ..... *E05B 27/005* (2013.01); *E05B 29/004* (2013.01); *E05B 29/0066* (2013.01); *Y10T 70/7588* (2015.04); *Y10T 70/774* (2015.04); *Y10T 70/7729* (2015.04)

(58) Field of Classification Search

CPC ... E05B 27/00; E05B 27/0007; E05B 27/001; E05B 27/005; E05B 27/0046; E05B 27/0017; E05B 27/0021; E05B 27/0053; E05B 27/0082; E05B 29/0026; E05B 29/004; E05B 29/0046; E05B 29/0066; Y10T 70/7729; Y10T 70/7588; Y10T 70/774; Y10T 70/7734

USPC ..... 70/419, 421, 382–385, 375, 337–343, 70/368, 492, 493, 495, 496, 358, 392, 70/376–378, DIG. 22, DIG. 23, DIG. 25

See application file for complete search history.

(56) References Cited

U.S. PATENT DOCUMENTS

| | | | | | |
|---|---|---|---|---|---|
| 758,026 | A | * | 4/1904 | Taylor | 70/421 |
| 758,027 | A | * | 4/1904 | Taylor | 70/421 |
| 1,244,304 | A | * | 10/1917 | Epstein | 70/493 |
| 1,906,701 | A | * | 5/1933 | Maxwell et al. | 70/421 |
| 1,915,897 | A | * | 6/1933 | Maxwell et al. | 70/407 |
| 1,977,189 | A | * | 10/1934 | Larson et al. | 70/421 |
| 2,049,548 | A | * | 8/1936 | Swanson | 70/493 |
| 3,137,156 | A | * | 6/1964 | Navarro | 70/492 |
| 3,475,933 | A | * | 11/1969 | Kobrehel | 70/495 |
| 3,507,133 | A | * | 4/1970 | Basseches | 70/421 |
| 3,589,153 | A | * | 6/1971 | Hill | 70/384 |
| 3,742,744 | A | * | 7/1973 | Lumme | 70/358 |
| 3,928,992 | A | * | 12/1975 | Talbot | 70/366 |
| 4,377,082 | A | * | 3/1983 | Wolter | 70/493 |
| 4,404,824 | A | * | 9/1983 | Hennessy | 70/495 |
| 4,434,636 | A | * | 3/1984 | Prunbauer | 70/358 |
| 4,471,638 | A | * | 9/1984 | Scheerhorn | 70/368 |
| 4,524,593 | A | * | 6/1985 | Hennessy | 70/358 |
| 4,570,355 | A | * | 2/1986 | De Forrest | 33/539 |
| 4,598,563 | A | * | 7/1986 | Berkowitz | 70/492 |
| 4,612,787 | A | * | 9/1986 | Prunbauer et al. | 70/358 |

(Continued)

*Primary Examiner* — Lloyd Gall

(74) *Attorney, Agent, or Firm* — Barnes & Thornburg LLP

(57) ABSTRACT

A rekeyable lock cylinder includes a plug body with a keyway opening along a longitudinal axis and a multiple of channels transverse to the axis. A rekeying feature located adjacent to the keyway opening.

17 Claims, 40 Drawing Sheets

(56) References Cited

U.S. PATENT DOCUMENTS

| | | | | | |
|---|---|---|---|---|---|
| 4,635,453 | A * | 1/1987 | Hart | 70/134 |
| 4,638,651 | A * | 1/1987 | Surko, Jr. | 70/495 |
| 4,667,493 | A * | 5/1987 | Takahashi | 70/366 |
| 4,703,638 | A * | 11/1987 | Bergstrom | 70/369 |
| 4,712,402 | A * | 12/1987 | Monahan | 70/383 |
| 4,732,023 | A * | 3/1988 | Shen | 70/383 |
| 4,753,091 | A * | 6/1988 | Sheets | 70/493 |
| 4,836,002 | A * | 6/1989 | Monahan | 70/382 |
| 4,850,210 | A * | 7/1989 | Adler et al. | 70/383 |
| 4,920,774 | A * | 5/1990 | Martin | 70/367 |
| 5,010,754 | A * | 4/1991 | De Angelo et al. | 70/389 |
| 5,050,412 | A * | 9/1991 | Errani | 70/358 |
| 5,077,994 | A * | 1/1992 | Trull et al. | 70/224 |
| 5,325,690 | A * | 7/1994 | Adler et al. | 70/383 |
| 5,540,071 | A * | 7/1996 | Reikher | 70/495 |
| 5,749,253 | A * | 5/1998 | Glick et al. | 70/278.2 |
| 5,799,519 | A * | 9/1998 | Hsiao | 70/358 |
| 5,823,027 | A * | 10/1998 | Glick et al. | 70/278.2 |
| 5,848,541 | A * | 12/1998 | Glick et al. | 70/278.3 |
| 5,884,512 | A * | 3/1999 | Wayne | 70/370 |
| 6,064,316 | A * | 5/2000 | Glick et al. | 340/5.65 |
| 6,079,240 | A * | 6/2000 | Shvarts | 70/367 |
| 6,301,942 | B1 * | 10/2001 | Shvarts | 70/367 |
| 6,474,118 | B2 * | 11/2002 | Martinez | 70/123 |
| 6,516,644 | B1 * | 2/2003 | Seliber | 70/340 |
| 6,526,791 | B2 * | 3/2003 | Shvarts | 70/419 |
| 6,745,603 | B1 * | 6/2004 | Shaw | 70/278.1 |
| 6,860,131 | B2 * | 3/2005 | Armstrong et al. | 70/492 |
| 6,862,909 | B2 * | 3/2005 | Armstrong et al. | 70/492 |
| 6,871,520 | B2 * | 3/2005 | Armstrong et al. | 70/492 |
| 6,889,533 | B2 * | 5/2005 | Fuller | 70/375 |
| 6,959,569 | B2 | 11/2005 | Strader et al. | |
| 7,100,408 | B2 * | 9/2006 | Nakasone | 70/375 |
| 7,100,409 | B2 * | 9/2006 | Chang | 70/493 |
| 7,104,098 | B2 * | 9/2006 | Romero et al. | 70/224 |
| 7,114,357 | B2 * | 10/2006 | Armstrong et al. | 70/492 |
| 7,117,701 | B2 * | 10/2006 | Armstrong et al. | 70/492 |
| 7,131,004 | B1 * | 10/2006 | Lyle | 713/169 |
| 7,181,937 | B2 * | 2/2007 | Keller | 70/338 |
| 7,213,429 | B2 * | 5/2007 | Armstrong et al. | 70/492 |
| 7,234,331 | B2 * | 6/2007 | Armstrong et al. | 70/492 |
| 7,295,578 | B1 * | 11/2007 | Lyle et al. | 370/503 |
| 7,308,811 | B2 * | 12/2007 | Armstrong et al. | 70/492 |
| 7,322,219 | B2 * | 1/2008 | Armstrong et al. | 70/492 |
| 7,412,053 | B1 * | 8/2008 | Lyle | 380/2 |
| 7,434,431 | B2 * | 10/2008 | Armstrong et al. | 70/492 |
| 7,558,326 | B1 * | 7/2009 | Lyle et al. | 375/244 |
| 7,878,036 | B2 | 2/2011 | Armstrong et al. | |
| 8,033,150 | B2 | 10/2011 | Armstrong et al. | |
| 8,347,678 | B2 | 1/2013 | Chong | |
| 8,770,000 | B2 | 7/2014 | Loreti | |
| 2004/0237612 | A1 * | 12/2004 | Nugent | 70/382 |
| 2011/0041577 | A1 | 2/2011 | Zhang | |

* cited by examiner

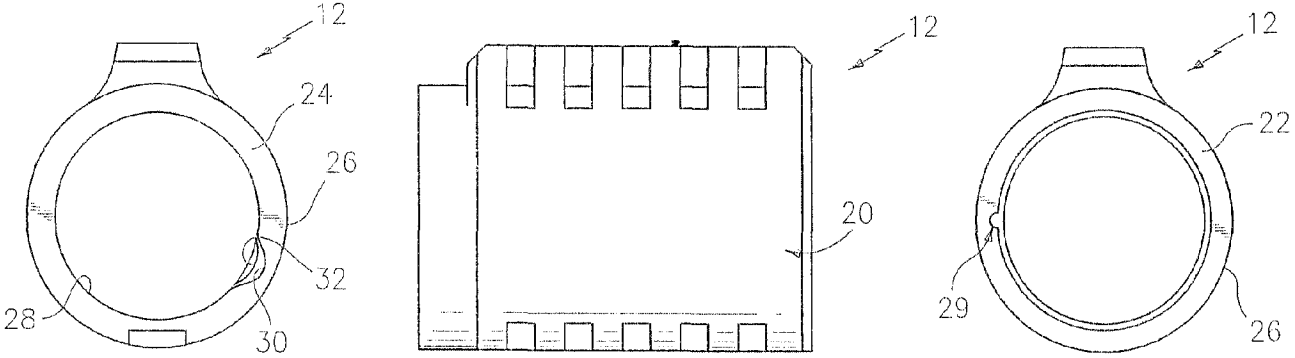
FIG. 15A
PRIOR ART
FIG. 15B
PRIOR ART
FIG. 15C
PRIOR ART
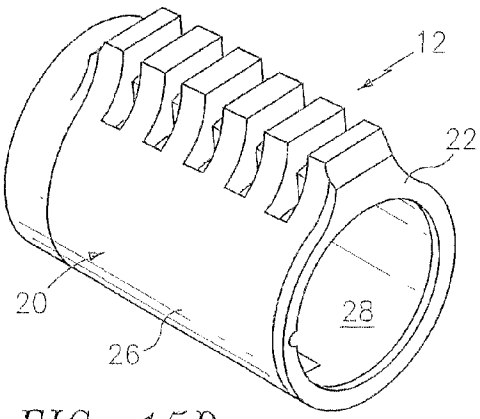
FIG. 15D
PRIOR ART
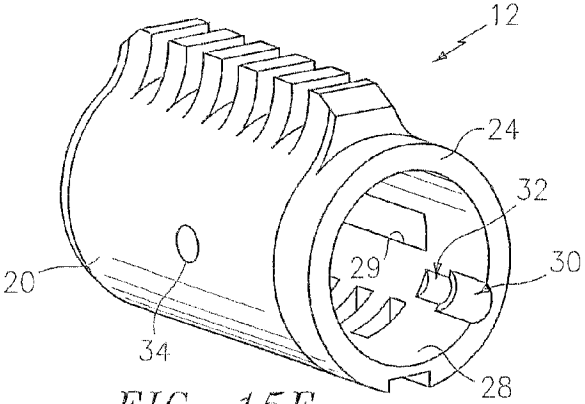
FIG. 15E
PRIOR ART

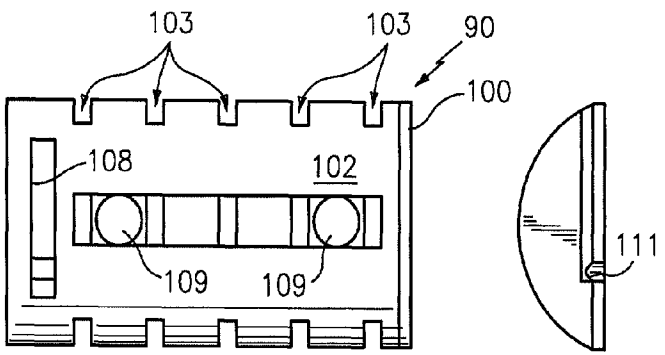
FIG. 17C PRIOR ART
FIG. 17D PRIOR ART
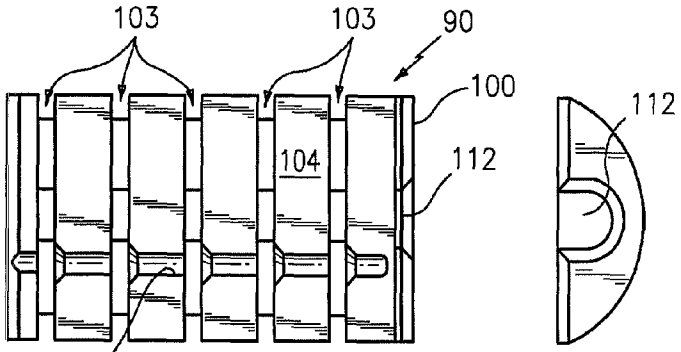
FIG. 17A PRIOR ART
FIG. 17B PRIOR ART
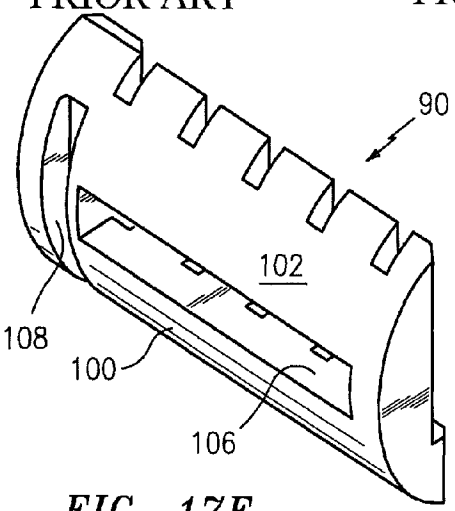
FIG. 17E PRIOR ART
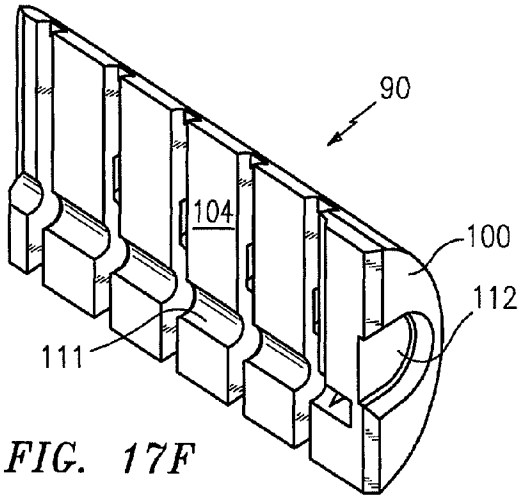
FIG. 17F PRIOR ART

REKEYABLE LOCK ASSEMBLY WITH BLOWN CYLINDER PROTECTION

RELATED APPLICATIONS

The present application is a Continuation of U.S. patent application Ser. No. 12/543,456, filed on Aug. 18, 2009, entitled "Rekeyable Lock Assembly with Blown Cylinder Protection," now abandoned. To the extent not included below, the subject matter disclosed in the application is hereby expressly incorporated into the present application.

BACKGROUND

The present disclosure relates to rekeyable lock cylinders.

When rekeying a cylinder using a traditional cylinder design, the cylinder plug is removed from the cylinder body and the appropriate pins are replaced so that a new key can be used to unlock the cylinder. This typically requires removal of the cylinder mechanism from the lockset and disassembly of the cylinder to some degree to remove the plug and replace the pins. This requires a working knowledge of the lockset and cylinder mechanism. Additionally, the process usually employs special tools and requires access to pinning kits to interchange pins and replace components that may become lost or damaged in the rekeying process.

Some rekeyable cylinder designs utilize the familiar experience of rotating the key in the lock cylinder such that no special knowledge, training, or tools to rekey the lock cylinder are required. In some instances, however, the cylinder is rotated before the new key is fully inserted. This may result in a mismatch between the new key and the plug and is referred to as a "blown cylinder."

Additional features and advantages of the rekeyable lock will become apparent to those skilled in the art upon consideration of the following detailed description of the illustrated embodiment exemplifying the best mode of carrying out the rekeyable lock as presently perceived.

SUMMARY

A rekeyable lock cylinder according to an exemplary aspect of the present disclosure includes a plug body with a keyway opening along a longitudinal axis and a multiple of channels transverse to the axis. A rekeying feature located adjacent to the keyway opening.

A rekeyable lock cylinder according to an exemplary aspect of the present disclosure includes a plug body positionable within a cylinder body, the plug body includes a keyway opening along a longitudinal axis. A rekeying feature adjacent to the keyway opening.

A method of rekeying a rekeyable lock cylinder according to an exemplary aspect of the present disclosure includes: inserting a first valid key in a home position of a keyway opening; rotating the plug body from the home position to a first position; inserting a tool in the tool-receiving aperture; removing the first key from the keyway; inserting a second key in the keyway until a key engagement member of a holding bar is received within a slot in the key; and rotating the plug body away from the first position.

BRIEF DESCRIPTION OF DRAWINGS

Various features will become apparent to those skilled in the art from the following detailed description of the disclosed non-limiting embodiment. The drawings that accompany the detailed description can be briefly described as follows:

FIGS. 15A-15E are various views of a prior art cylinder body.

FIGS. 17A-17F are various views of the prior art carrier.

DETAILED DESCRIPTION OF THE DRAWINGS

Figure 1:
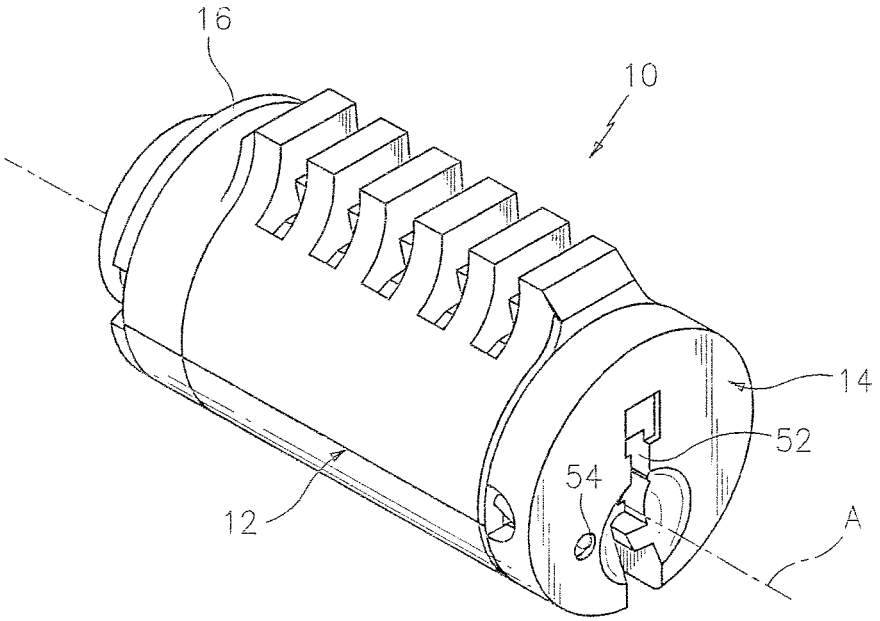
FIG. 1 PRIOR ART
FIG. 1 illustrates a prior art lock cylinder.
Figure 2:
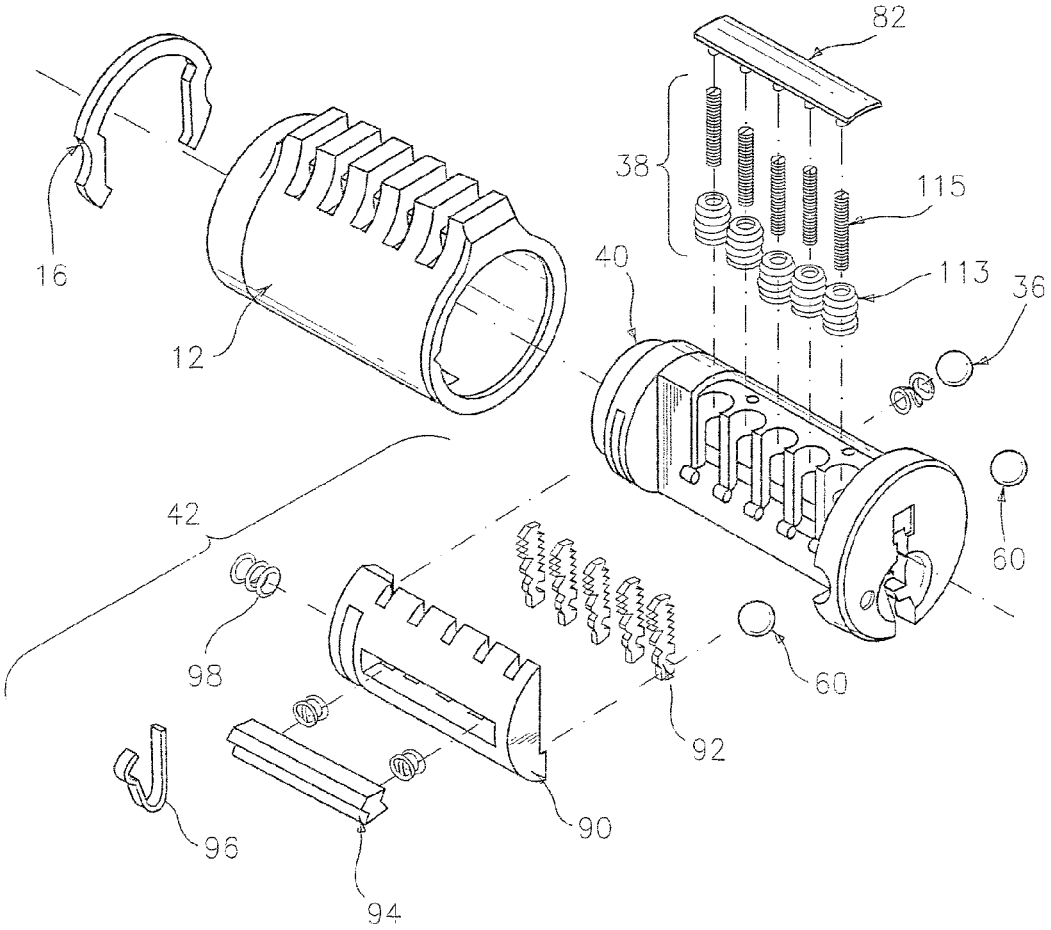
FIG. 2 PRIOR ART
FIG. 2 is an exploded view of the prior art lock cylinder of FIG. 1.

A lock cylinder 10 according to one non-limiting embodiment of the present disclosure is illustrated in FIGS. 1 and 2. The lock cylinder 10 includes a longitudinal axis A, a cylinder body 12, a plug assembly 14 and a retainer 16. In FIG. 1, the plug assembly 14 is in a home position relative to the cylinder body 12. The lock cylinder 10 of the present disclosure is operable with any conventional locking mechanism including, but not limited to, handlesets, knobsets, leversets, and even padlocks.

The cylinder body 12, as seen in FIGS. 15A-15E, includes a generally cylindrical body 20 having a front end 22, a back end 24 and a cylinder wall 26 defining an interior surface 28. The cylinder wall 26 includes an interior, locking bar-engaging groove 29 and a pair of detent recesses 30, 32. The generally V-shaped locking bar-engaging groove 29 extends longitudinally along a portion of the cylinder body 12 from the front end 22. The first detent recess 30 is disposed at the back end 24 and extends to a first depth. The second detent recess 32 is disposed adjacent the first detent recess 30 and extends to a lesser depth. A detent bore 34 extends radially through the cylinder wall 26 for receiving a detent ball 36 (FIG. 2).

Figure 20A:
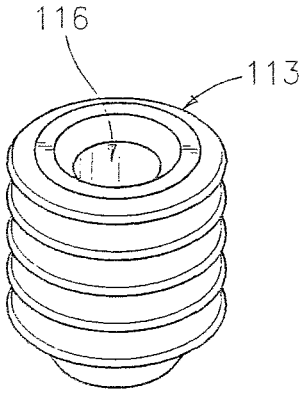
FIG. 20A PRIOR ART
FIGS. 20A-20B are views of a prior art pin.
Figure 20B:
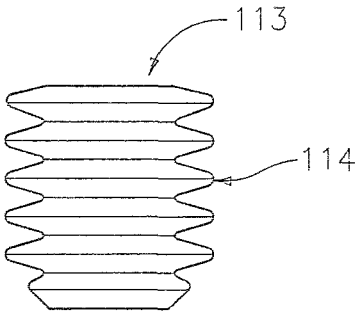
FIG. 20B PRIOR ART

Referring to FIG. 2, the plug assembly 14 includes a plug body 40, a carrier sub-assembly 42 and a plurality of spring-loaded pins 38 (FIGS. 20A and 20B). The plug body 40, illustrated in FIGS. 16A-16F, includes a plug face 44, an intermediate portion 46 and a drive portion 50. The plug face 44 defines a keyway opening 52, a rekeying tool opening 54 and a pair of channels 56 extending radially outwardly for receiving anti-drilling ball bearings 60. The drive portion 50 includes an annular wall 62 with a pair of opposed projections 64 (FIG. 16E) extending radially inwardly to drive a spindle or torque blade (neither shown). The drive portion 50 further includes a pair of slots 66 formed in its perimeter for receiving the retainer 16 to retain the plug body 40 in the cylinder body 12.

The intermediate portion 46 includes a main portion 70 formed as a cylinder section having a first longitudinal planar surface 72 and a plurality of channels 74 transverse to the axis A for receiving the spring-loaded pins 38. The channels 74 extend transversely to the longitudinal axis of the plug body 40 and parallel to the planar surface 72. A second planar surface 76 extends perpendicular to the first planar surface 72 and defines a recess 80 for receiving a retaining cap 82 (FIGS. 22A-22D). The channels 74 extend from the second planar surface 76 partially through the plug body 40, with the side-walls of the channels open to the first planar surface 72. The first planar surface 72 further includes a plurality of bullet-shaped, rack-engaging features 78. A bore 86 for receiving a spring-loaded detent ball 36 extends radially inwardly from opposite the first planar surface 72.

Figure 6:
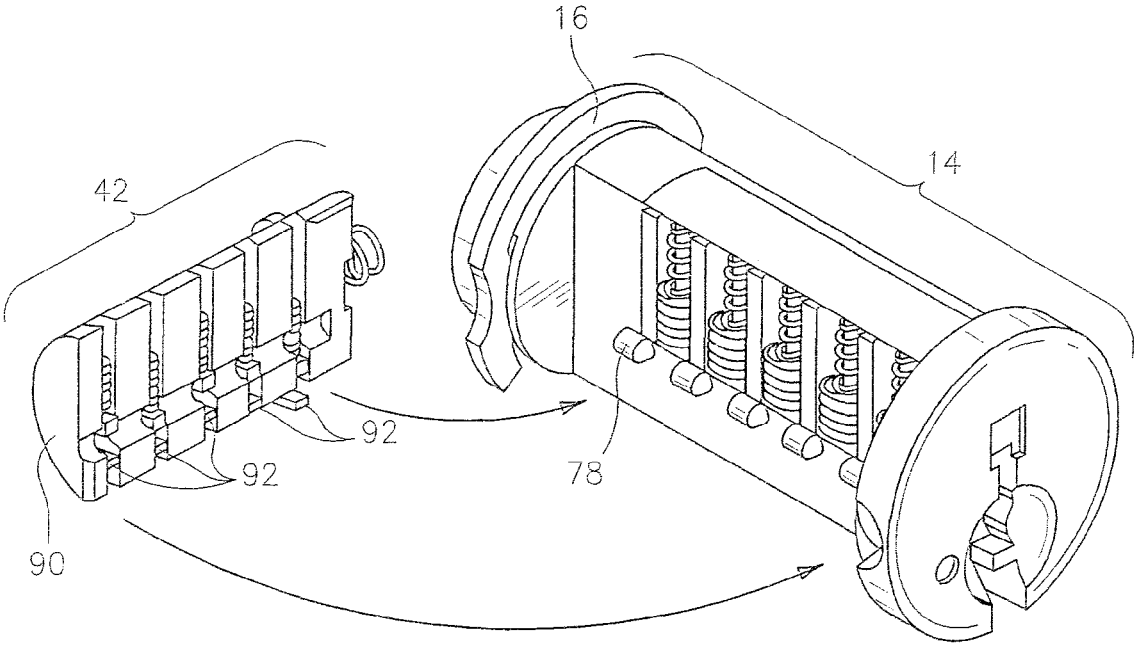
FIG. 6 PRIOR ART
FIG. 6 is a partially exploded view of the prior art plug assembly of FIG. 3.
Figure 10:
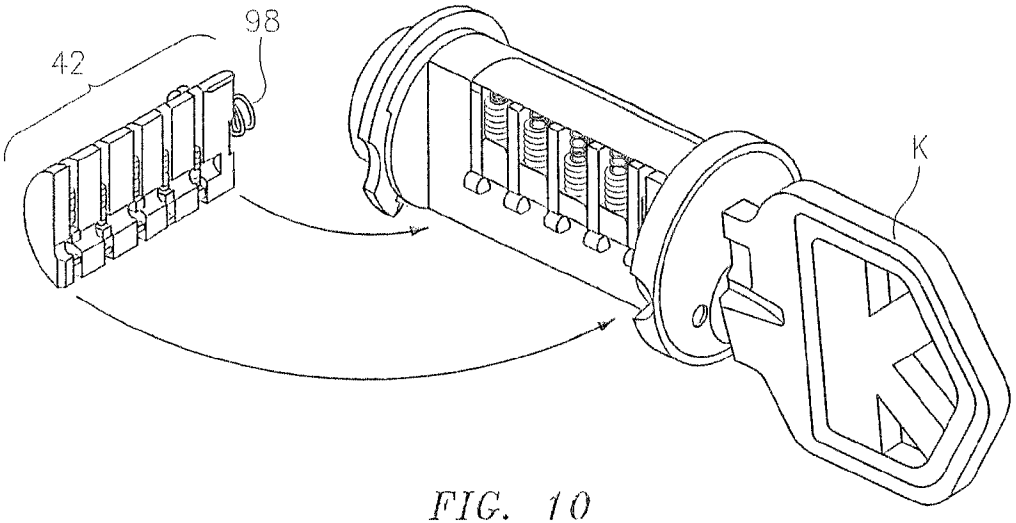
FIG. 10 PRIOR ART
FIG. 10 is a partially broken away side view of the prior art plug assembly of FIG. 8.
Figure 11:
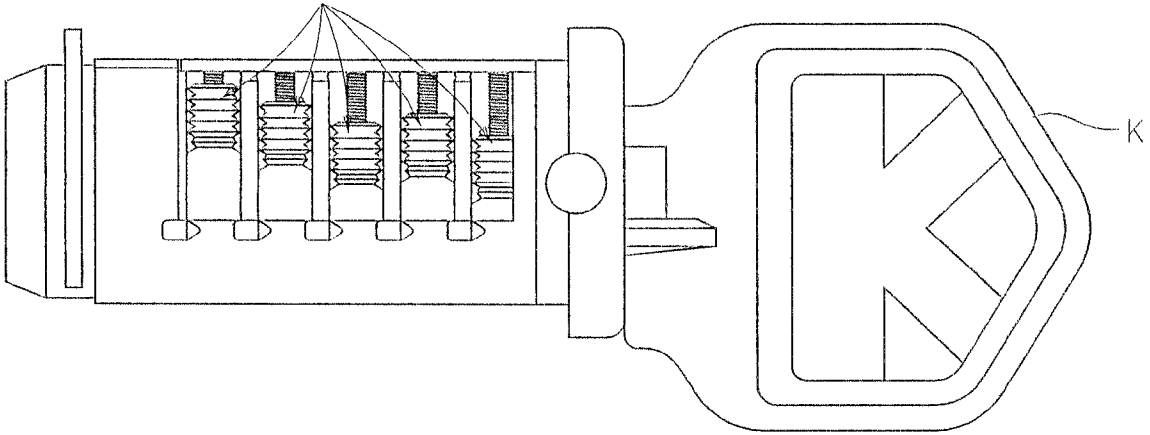
FIG. 11 PRIOR ART
FIG. 11 is a partially exploded view of the prior art plug assembly of FIG. 8.
Figure 18A:
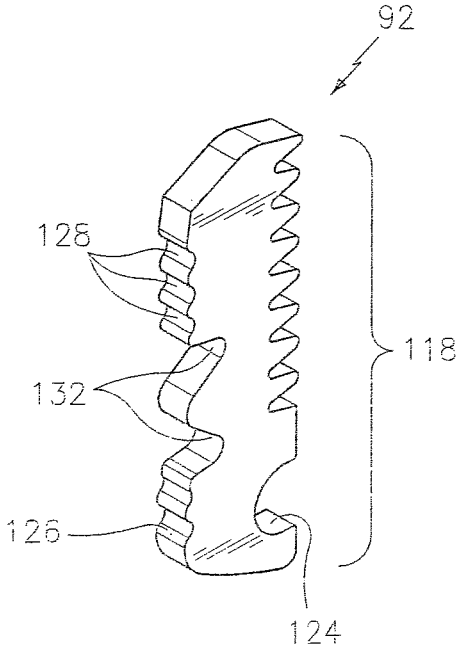
FIG. 18A PRIOR ART
FIGS. 18A-18B are views of a prior art rack.
Figure 18B:
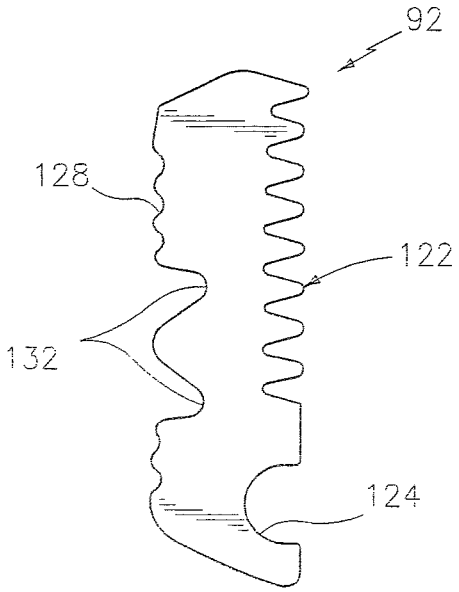
FIG. 18B PRIOR ART
Figure 19A:
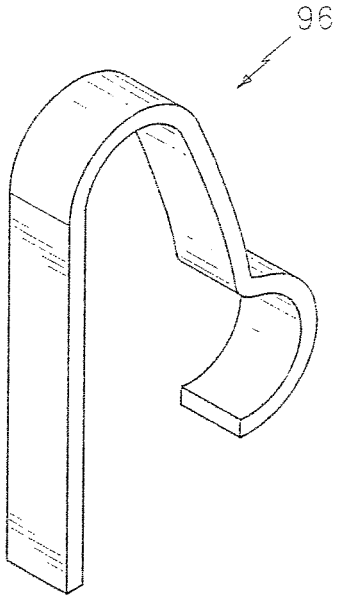
FIG. 19A PRIOR ART
FIGS. 19A-19B are views of a prior art spring catch.
Figure 19B:
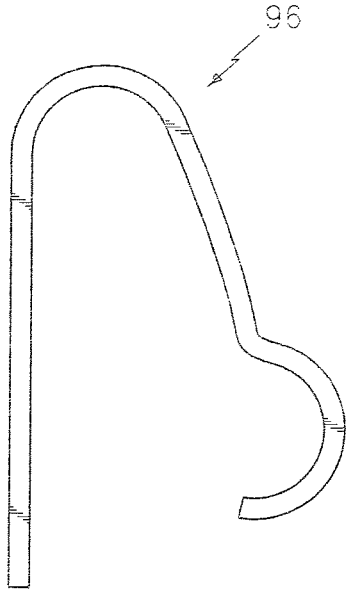
FIG. 19B PRIOR ART
Figure 21B:
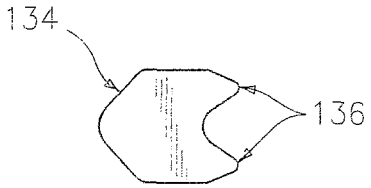
FIG. 21B PRIOR ART
FIGS. 21A-21B are views of a prior art locking bar.

The carrier sub-assembly 42 (FIGS. 6 and 10) includes a carrier 90 (FIGS. 17A-17E), a plurality of racks 92 (FIGS. 18A-18B), a spring catch 96 (FIGS. 19A and 19B), a spring-loaded locking bar 94 (FIGS. 21A and 21B), and a return spring 98. The carrier 90 includes a body 100 in the form of a cylinder section that is complementary to the main portion 70 of the plug body 40, such that the carrier 90 and the main portion 70 combine to form a cylinder that fits inside the cylinder body 12. The carrier 90 includes a curved surface and a flat surface 104. The curved surface includes a locking bar recess 106 and a spring catch recess 108. The locking bar recess 106 further includes a pair of return spring-receiving bores 109 (FIG. 17C) for receiving the locking bar return springs. The flat surface 104 includes a plurality of parallel rack-receiving slots 103 extending perpendicular to the longitudinal axis A of the carrier 90. A semi-circular recess 111 extends along the flat surface 104 parallel to the longitudinal axis of the carrier 90. The hack end of the carrier 90 includes a recess 112 to receive the return spring 98.

Figure 7:
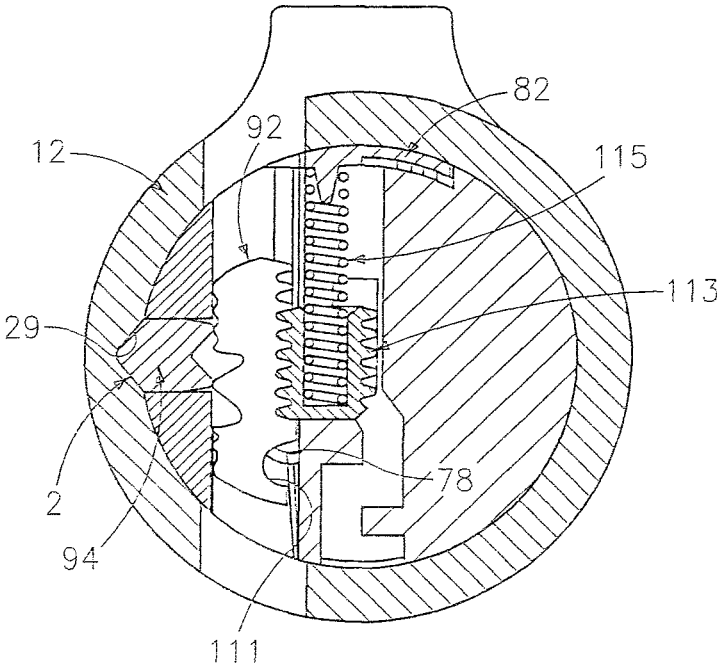
FIG. 7 PRIOR ART
FIG. 7 is a section view through the prior art plug assembly of FIG. 3 and a cylinder body, the section being taken transversely at one of the pins and illustrating the positioning of the pin, a rack, and the locking bar relative to each other and the cylinder body in a locked configuration.
Figure 12:
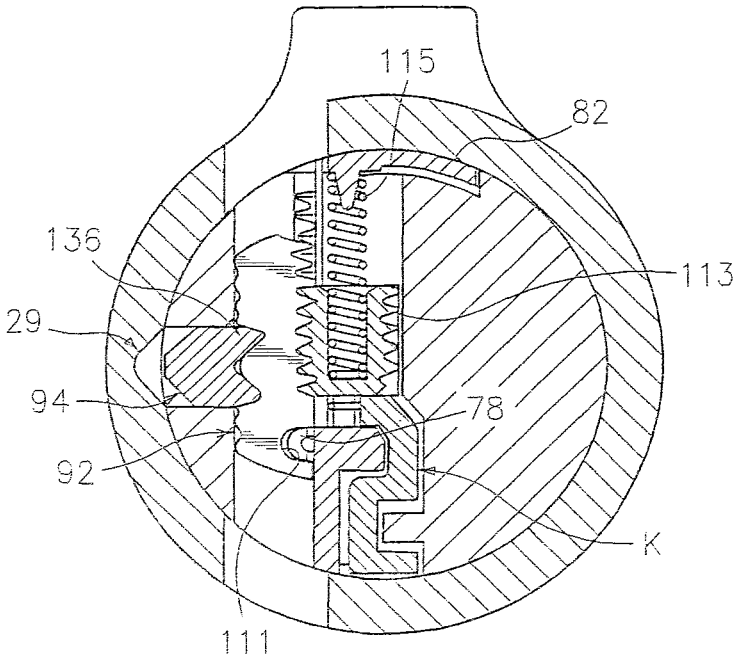
FIG. 12 PRIOR ART
FIG. 12 is a section view through the prior art plug assembly of FIG. 8 and a cylinder body, the section being taken transversely at one of the pins and illustrating the positioning of the pin, the rack, and the locking bar relative to each other and the cylinder body in an unlocked configuration.

Each spring-loaded pin 38 includes a pin 113 and a biasing spring 115. The pins 113, illustrated in FIGS. 20A and 20B, are generally cylindrical with annular gear teeth 114 and a central longitudinal bore 116 for receiving biasing springs 115. The racks 92, illustrated in FIGS. 18A and 18B, include a pin-engaging surface 118 having a plurality of gear teeth 122 configured to engage the annular gear teeth 114 on the pins 113, as illustrated in FIGS. 7 and 12, and a semi-circular recess 124 for engaging the bullet-shaped, rack-engaging features 78 on the planar surface 72, as illustrated in FIG. 12. The racks 92 further include a second surface 126 that includes a plurality of anti-pick grooves 128 and a pair of locking bar-engaging grooves 132.

Figure 21A:
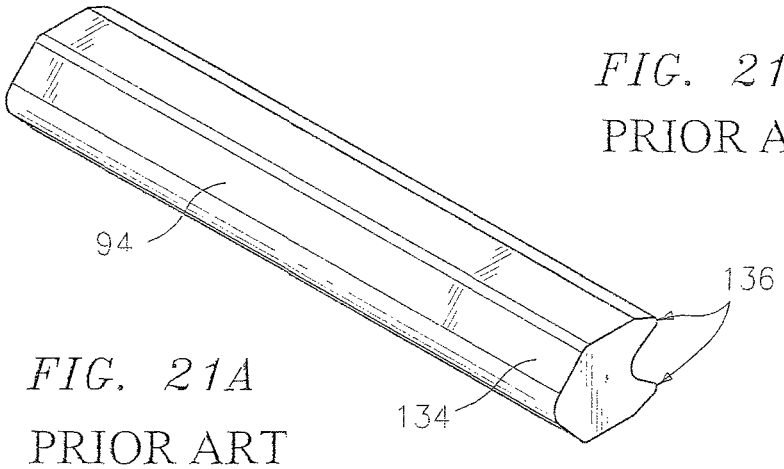
FIG. 21A PRIOR ART
Figure 22A:
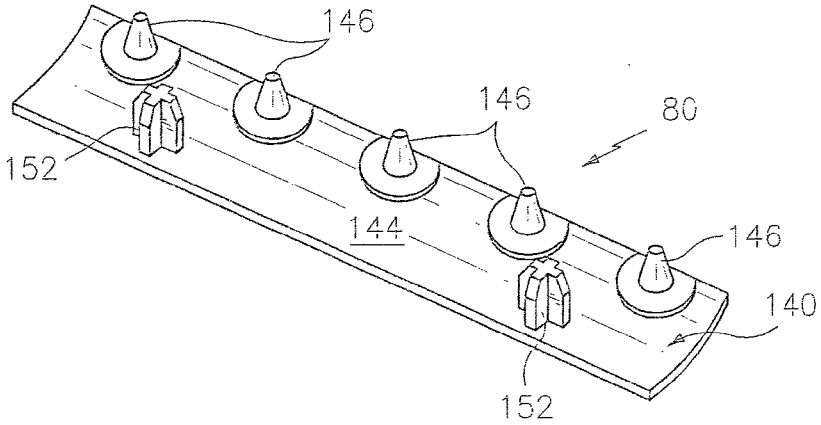
FIG. 22A PRIOR ART
FIGS. 22A-22D are views of a prior art spring retaining cap.
Figure 22B:
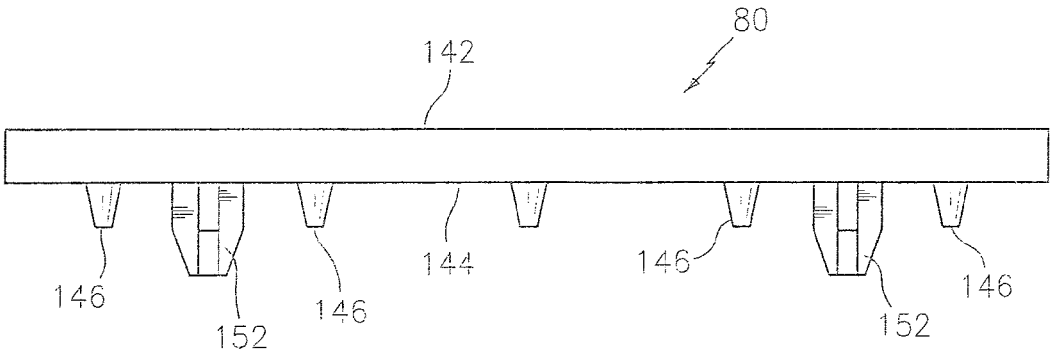
FIG. 22B PRIOR ART
Figure 22C:
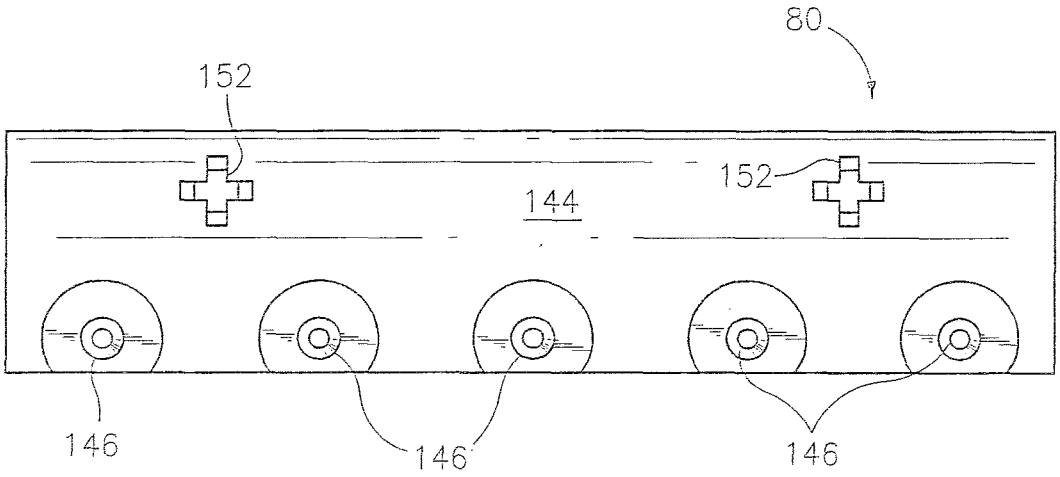
FIG. 22C PRIOR ART
Figure 22D:
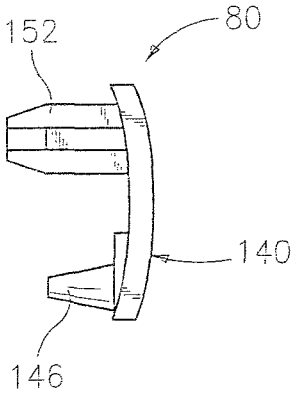
FIG. 22D PRIOR ART

The spring-loaded locking bar 94, illustrated in FIGS. 21A and 22B, is sized and configured to fit in the locking bar recess 106 in the carrier 90 and includes a triangular edge 134 configured to fit in the V-shaped locking bar-engaging groove 29. Opposite the triangular edge 134, the locking bar 94 includes a pair of longitudinally extending gear teeth 136 configured to engage the locking bar-engaging grooves 132 formed in the racks 92, as illustrated in FIG. 12.

Figure 16A:
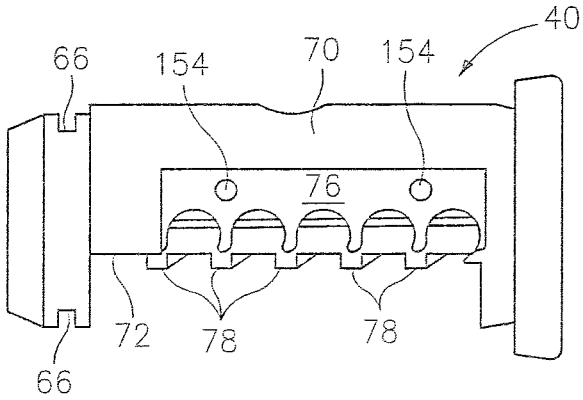
FIG. 16A PRIOR ART
FIGS. 16A-16F are various views of the prior art cylinder plug body.
Figure 16B:
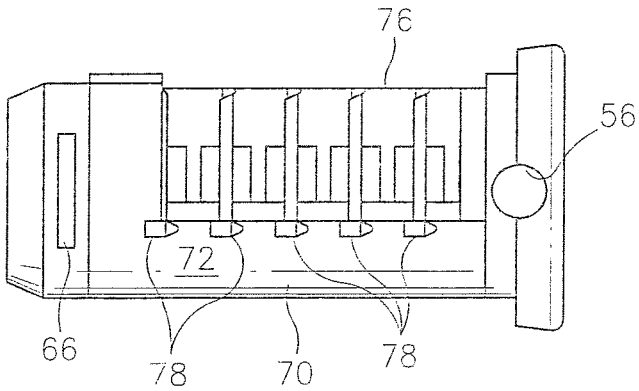
FIG. 16B PRIOR ART
Figure 16C:
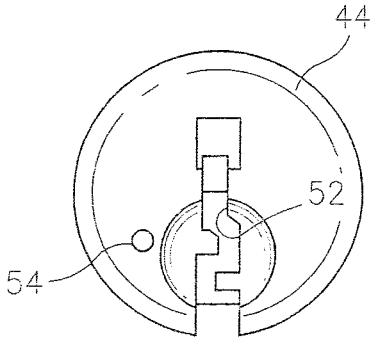
FIG. 16C PRIOR ART
Figure 16D:
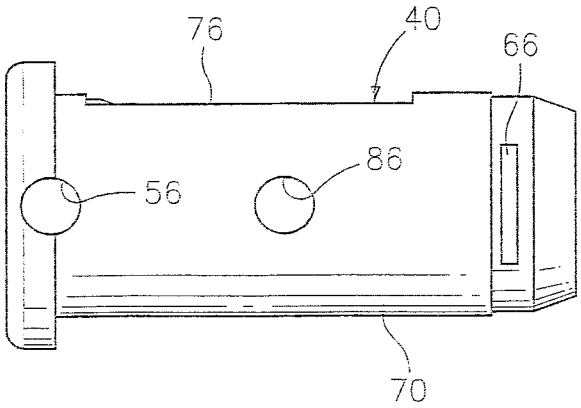
FIG. 16D PRIOR ART
Figure 16F:
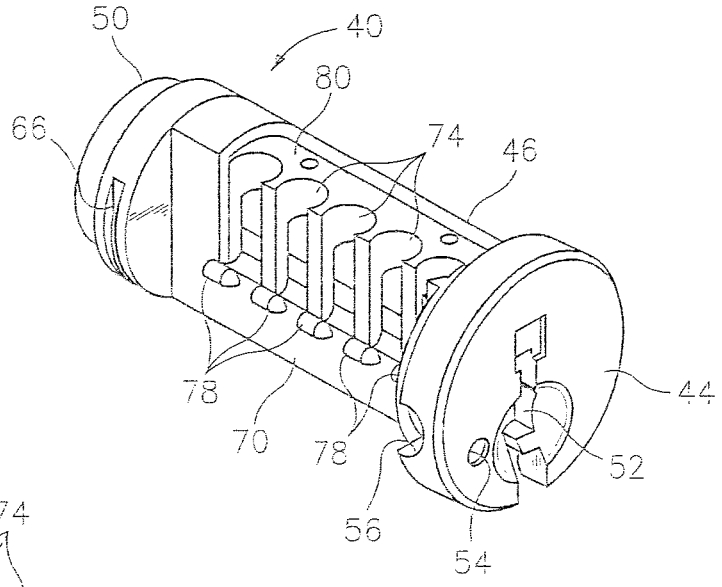
FIG. 16F PRIOR ART
Figure 16E:
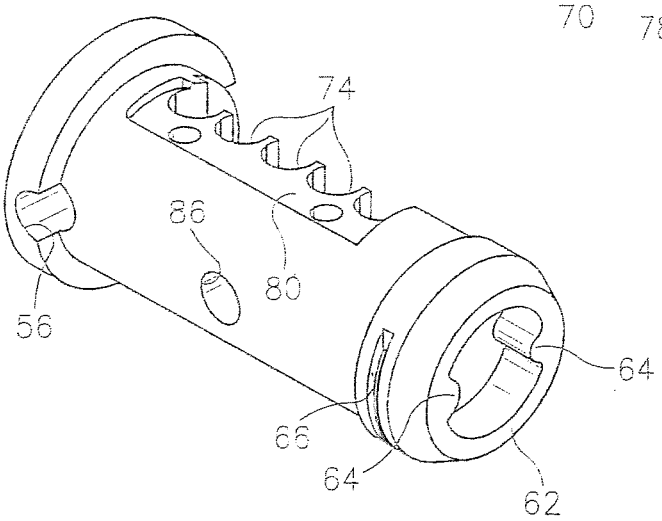
FIG. 16E PRIOR ART

The spring-retaining cap 82, illustrated in FIGS. 22A-22D, includes a curvilinear portion 140 having an upper surface 142 and a lower surface 144. The thickness of the curvilinear portion 140 is set to allow the curvilinear portion 140 to fit in the recess 80 with the upper surface 142 flush with the intermediate portion 46 of the plug body 40, as illustrated in FIGS. 7 and 12. A plurality of spring alignment tips 146 extend from the lower surface 144 to engage the springs 115. In addition, a pair of cap retaining tips 152 extend from the lower surface 144 to engage alignment openings 154 formed in the plug body 40 (FIGS. 16E and 16F).

To assemble the lock cylinder 10, the pins 113 and spring 115 are disposed in the channels 74 of the plug body 40. The spring-retaining cap 82 is placed in the recess 80, with the cap retaining tips 152 disposed in the alignment openings 154 and the spring alignment tips 146 engaged with the springs 115. The carrier sub-assembly 42 is assembled by placing the racks 92 into the slots 103 and the spring-loaded locking bar 94 into the locking bar recess 106, with the gear teeth 136 engaging the locking bar-engaging grooves 132 formed in the racks 92.

Figure 3:
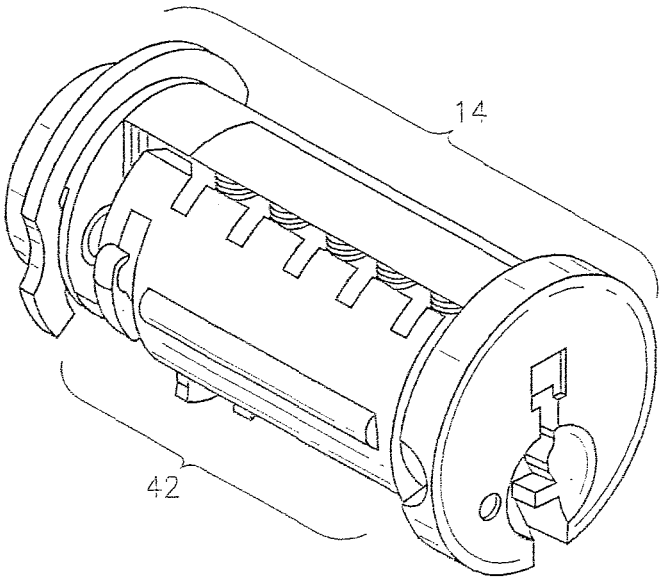
FIG. 3 PRIOR ART
FIG. 3 is a perspective view of a prior art plug assembly illustrating a carrier sub-assembly with a locking bar disposed in a locking position to lock the plug assembly in a lock cylinder body.

The spring catch 96 is disposed in the spring catch recess 108 of the carrier 90. A valid key K is inserted into the keyway opening 52, the return spring 98 is compressed into the return spring recess 112, and the carrier sub-assembly 42 is placed adjacent the plug body 40, as illustrated in FIG. 3. The plug assembly 14 is placed in the cylinder body 12 and the retainer 16 is disposed in the slots 66 formed in the plug body 40 to retain the plug assembly 14 in the cylinder body 12. The lock cylinder 10 is now keyed to the valid key K.

Figure 4:
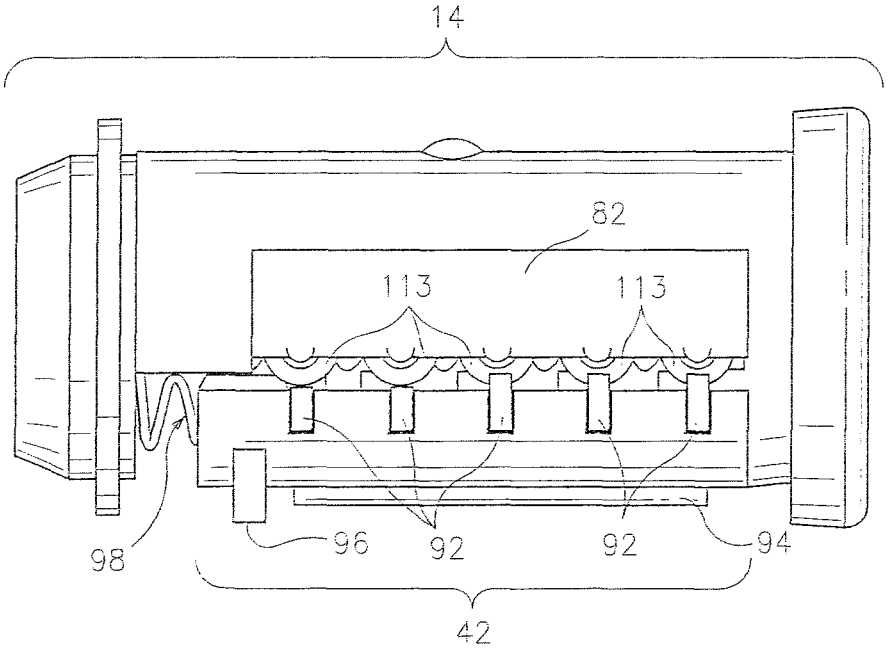
FIG. 4 PRIOR ART
FIG. 4 is a top plan view of the prior art plug assembly of FIG. 3.
Figure 5:
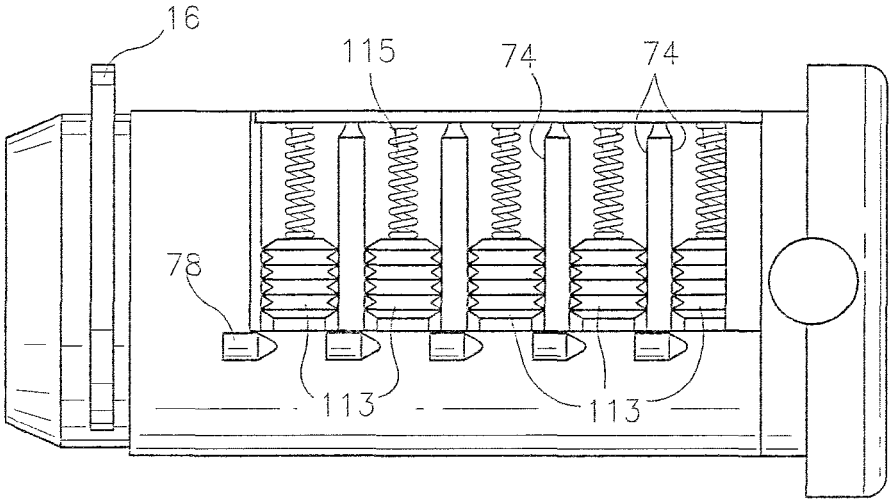
FIG. 5 PRIOR ART
FIG. 5 is a partially broken away side view of the prior art plug assembly of FIG. 3.

The properly keyed lock cylinder 10, without the key K inserted, is illustrated in FIGS. 4-7. The pins 113 are biased to the bottom of the channels 74 and, based on the cut of the key K, the racks 92 are disposed at various positions in the slots 103 of the carrier 90. In this configuration, the locking bar 94 extends from the carrier 90 to engage the groove 29 in the cylinder body 12 to prevent the plug assembly 14 from rotating in the cylinder body 12 and the racks 92 engage the pins 113, as illustrated in FIG. 4. In addition, the bullet-shaped features 78 are misaligned with the recesses 124 in the racks 92 and therefore interfere with movement of the racks 92 parallel to the longitudinal axis A of the lock cylinder 10, which thereby prevents the lock cylinder 10 from being rekeyed.

Figure 8:
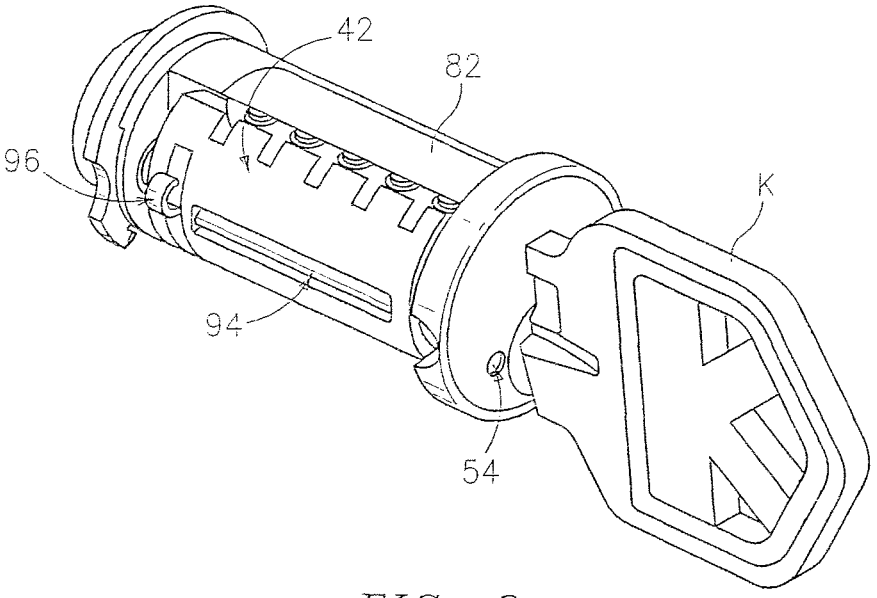
FIG. 8 PRIOR ART
FIG. 8 is a perspective view of the prior art plug assembly of FIG. 3 with a valid key inserted therein and illustrating the locking bar disposed in an unlocking position to allow the plug assembly to rotate in the lock cylinder body.
Figure 9:
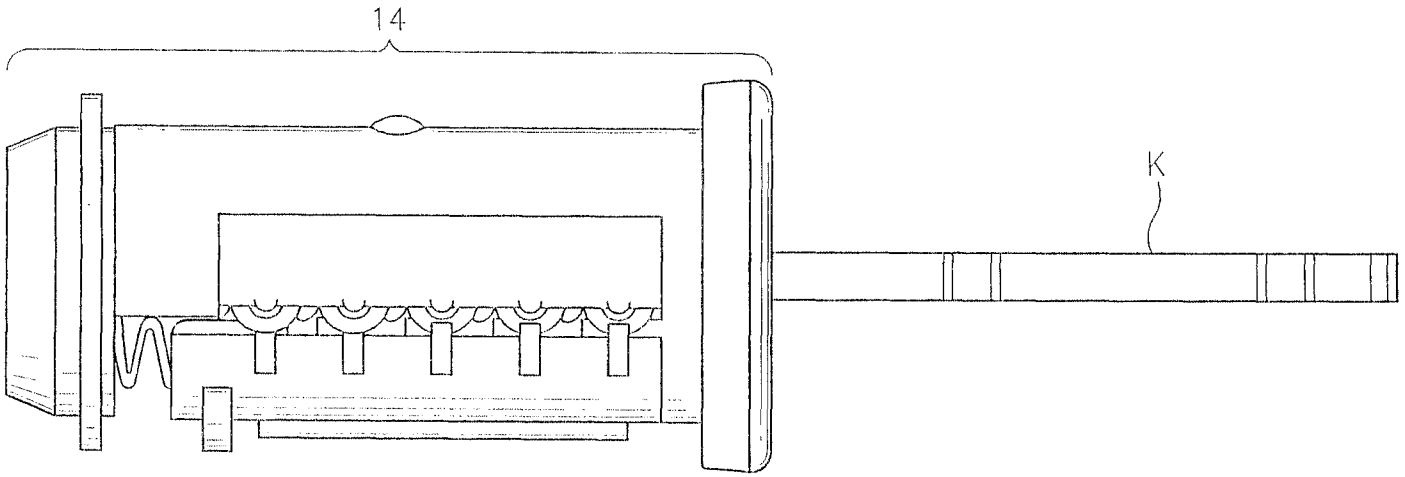
FIG. 9 PRIOR ART
FIG. 9 is a top plan view of the prior art plug assembly of FIG. 8.

The internal configuration of a lock cylinder 10 with the valid key K inserted therein at the home position is illustrated in FIGS. 8-12. In this configuration, the locking bar 94 is free to cam out of the groove 29 in the cylinder body 12, as depicted in FIGS. 8, 9 and 12. The bits of the key K lift the pins 113 in the channels 74 and thereby re-position the racks 92 in the slots 102. When repositioned, the racks 92 are disposed to align the locking bar-engaging grooves 132 with the extended gear teeth 136 on the locking bar 94. The locking bar 94 is free to cam out of the groove 29 as the key K is rotated. At the same time, the bullet-shaped features 78 are aligned with the recesses 124 in the racks 92, as illustrated in FIG. 12, allowing the racks 92, and the carrier 90, to move parallel to the longitudinal axis of the lock cylinder 10.

Figure 13:
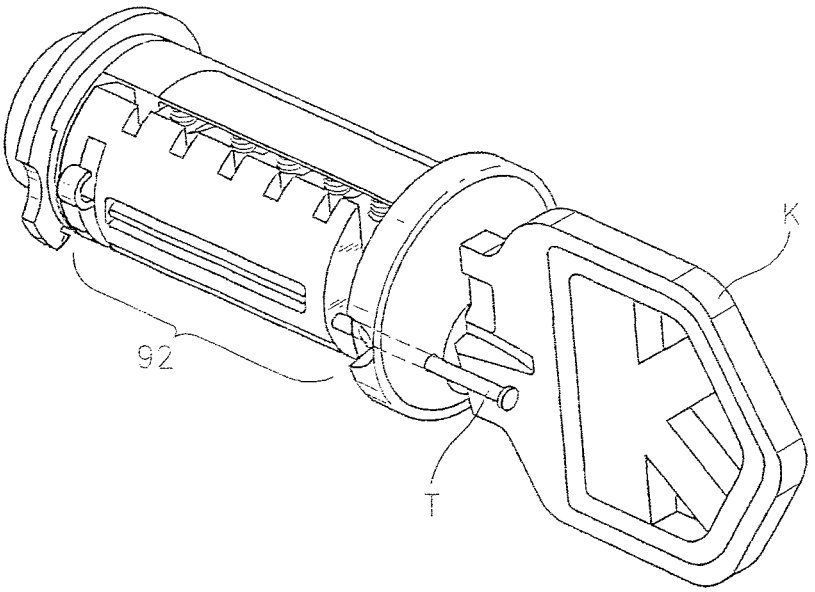
FIG. 13 PRIOR ART
FIG. 13 is a perspective view similar to FIG. 8 but with the prior art carrier assembly moved axially to a rekeying position.
Figure 14:
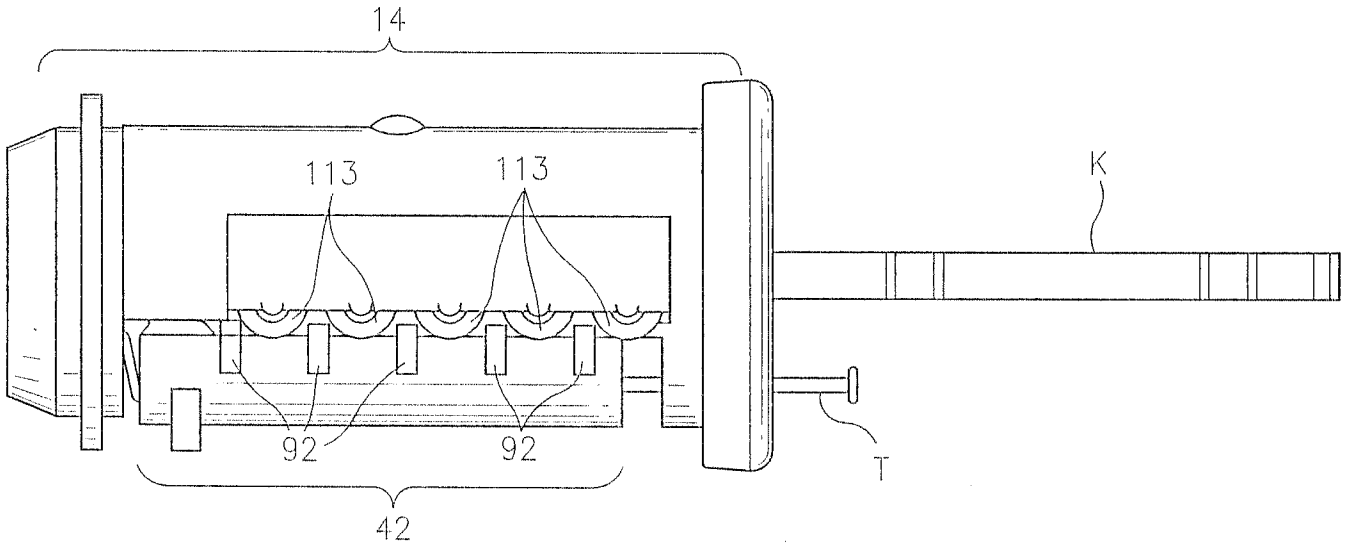
FIG. 14 PRIOR ART
FIG. 14 is a top plan view of the prior art plug assembly of FIG. 13.

To rekey the lock cylinder 10, the valid key K is inserted into the keyway opening 52, as illustrated in FIGS. 13-14 and rotated approximately 45° counterclockwise from the home position until the spring catch 96 moves into the second detent recess 32 formed in the cylinder body 12. A pointed tool T is inserted into the tool opening 54 and pushed against the carrier 90 to move the carrier 90 parallel to the longitudinal axis of the lock cylinder 10 until the spring catch 96 moves into the first detent recess 30, and the pointed tool T is removed.

With the spring catch 96 disposed in the first detent recess 30, the racks 92 are disengaged from the pins 113, as illustrated in FIG. 14. The valid key K is removed and a second valid key with a different bit arrangement is inserted and rotated clockwise to release the spring catch 96. As the spring catch 96 leaves the first detent recess 30, the carrier 90 is biased toward the plug face 44 by the return spring 98, causing the racks 92 to re-engage the pins 113. At this point, the lock cylinder 10 is rekeyed to the second valid key and the first valid key K no longer operates the lock cylinder 10. The lock cylinder 10 can be rekeyed to fit a third valid key by replacing the first and second valid keys in the above procedures with the second and third valid keys, respectively.

An alternative embodiment of a lock cylinder 200 is illustrated in FIGS. 23-30. The alternative embodiment generally includes the same components as described in the embodiment above, but some of the components have been modified. Functionally, both embodiments are generally the same with the exception that the FIG. 23 embodiment also includes a rekeying feature 300 (FIG. 31) in the plug body 202.

A cylinder body 212, illustrated in FIGS. 24A-24D, includes a plurality of apertures 214 running longitudinally along the bottom thereof and a pair of vertical grooves 216, 218 (FIG. 24B) formed in the housing sidewall. In addition, the sidewall includes a removable side panel 220. The rectangular apertures 214 are positioned to allow the use of a manual override tool. The center groove 216 includes an aperture 222 extending through the housing sidewall. The aperture 222 allows a user to move the locking bar 252 during a manual override operation. The side panel 220 also provides access for performing certain operations.

A set of pin biasing springs 226 (also illustrated in FIG. 25) include a non-constant diameter, with the last few coils at each end of the springs 226 having a reduced diameter. The taper allows for a greater spring force in a smaller physical height.

Figure 27A:
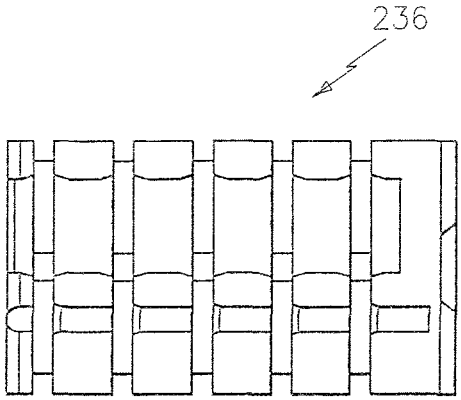
FIG. 27A PRIOR ART
FIGS. 27A-27E are views of an alternative embodiment of the prior art carrier.
Figure 27B:
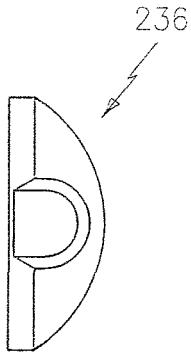
FIG. 27B PRIOR ART
Figure 27C:
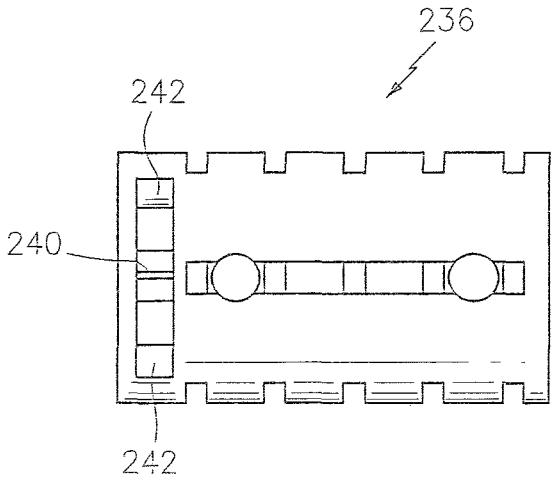
FIG. 27C PRIOR ART
Figure 27D:
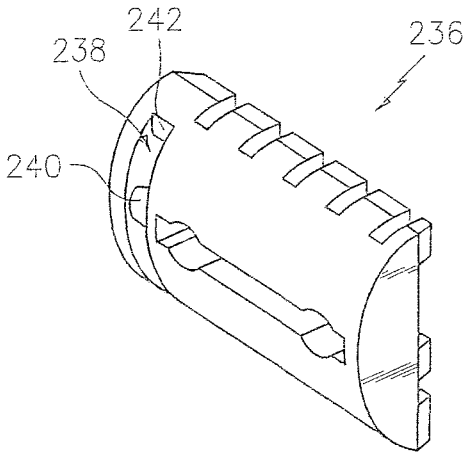
FIG. 27D PRIOR ART
Figure 27E:
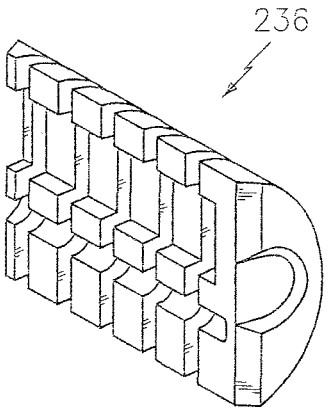
FIG. 27E PRIOR ART
Figure 28A:
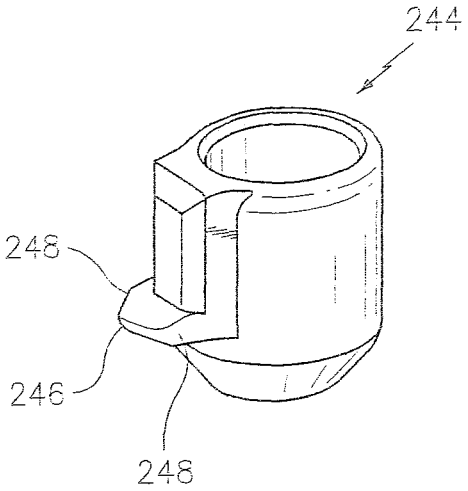
FIG. 28A PRIOR ART
FIGS. 28A-28B are views of an alternative embodiment of the prior art pin.
Figure 28B:
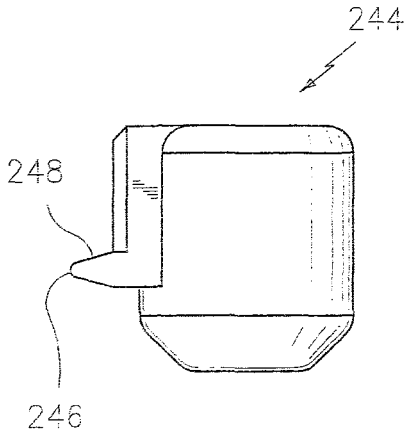
FIG. 28B PRIOR ART
Figure 29A:
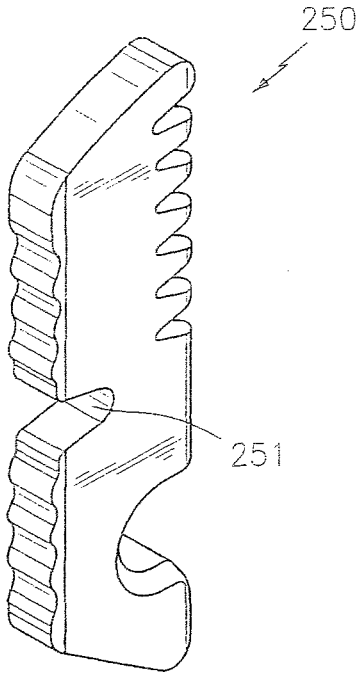
FIG. 29A PRIOR ART
FIGS. 29A-29B are views of an alternative embodiment of the prior art rack.
Figure 29B:
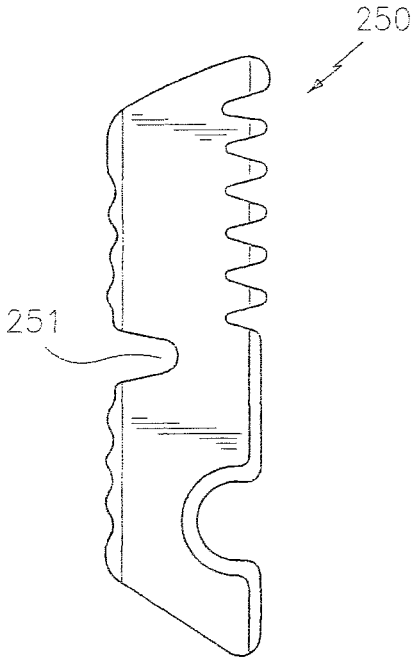
FIG. 29B PRIOR ART
Figure 30A:
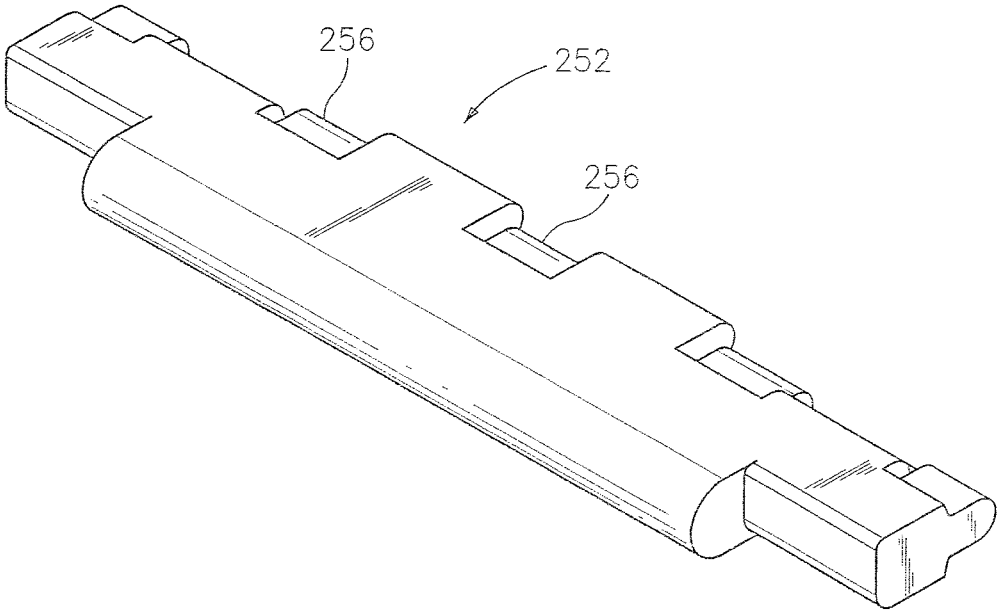
FIG. 30A PRIOR ART
FIGS. 30A-30B are views of an alternative embodiment of the prior art locking bar.
Figure 30B:
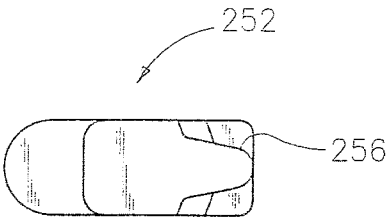
FIG. 30B PRIOR ART

A spring catch 228 (FIGS. 26A-26B) is located inboard of the locking bar 252. The carrier 236 (FIGS. 27A-37E) retains the spring catch 228 in the spring catch recess 238. In the illustrated embodiment, this includes a guide 240 which projects outwardly in the center of the spring catch recess 238 and a pair of anchors 242 radially offset from the guide 240 (FIGS. 27C-27D). The guide 240 prevents the spring catch 228 from moving transversely in the recess 238 yet permits radial movement outwardly to engage the cylinder body 212 as described above. The anchors 242 engage the arms 232 of the spring catch 228 and prevent the arms 232 from splaying outwardly, thereby directing the compressive force of the spring catch 228 to extend the U-shaped portion 230 outwardly to engage the cylinder body 212.

The pins 244 (FIGS. 28A-28B) include a single gear tooth 246 instead of the plurality of gear teeth of the pins 113 described above. The single gear tooth 246, which includes beveled sides 248, provides for a relatively smoother engagement with the racks during the rekeying process.

The racks 250 (FIGS. 29A-29B) include beveled gear teeth to improve the engagement with the pins during the rekeying process. In addition, the pair of locking bar-engaging grooves 132 in the racks 92 are replaced with a single locking bar-engaging groove 251.

The modified locking bar 252 (FIGS. 30A-30B) is relatively thinner than locking bar 94 and replaces the pair of gear teeth 136 with a single gear tooth 256 and rounds out the triangular edge 134.

Figure 23:
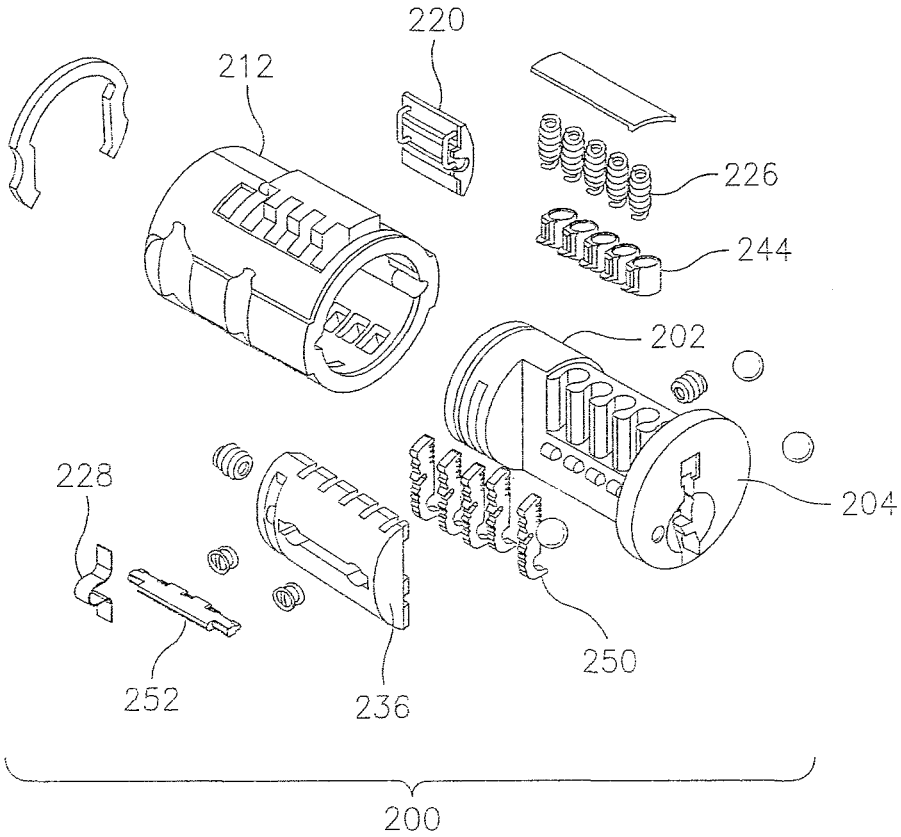
FIG. 23 PRIOR ART
FIG. 23 is an exploded perspective view of a prior art alternative embodiment.
Figure 24A:
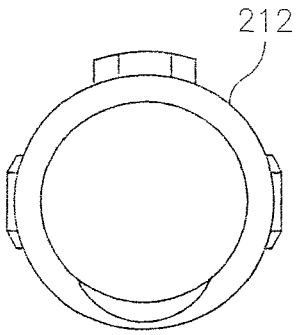
FIG. 24A PRIOR ART
FIGS. 24A-24E are views of an alternative embodiment of the prior art lock cylinder housing.
Figure 24B:
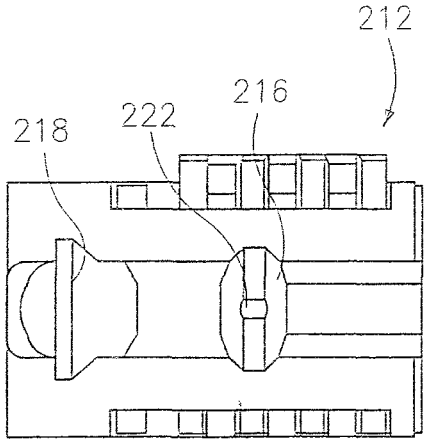
FIG. 24B PRIOR ART
Figure 24C:
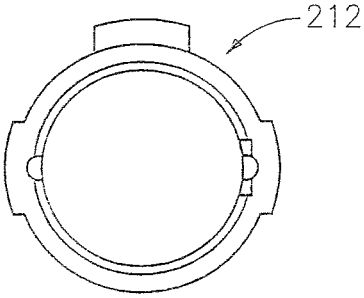
FIG. 24C PRIOR ART
Figure 24D:
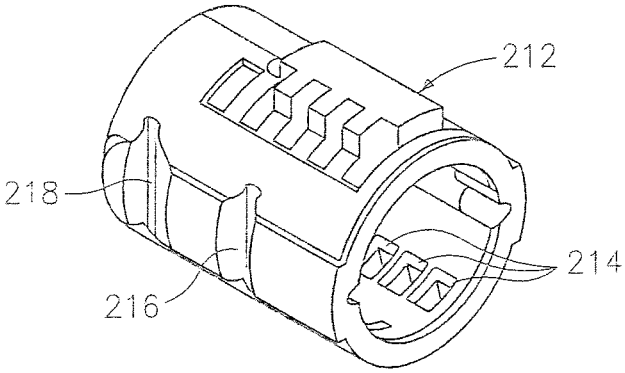
FIG. 24D PRIOR ART
Figure 24E:
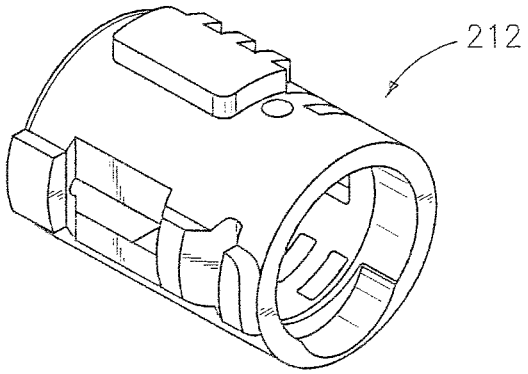
FIG. 24E PRIOR ART
Figure 25:
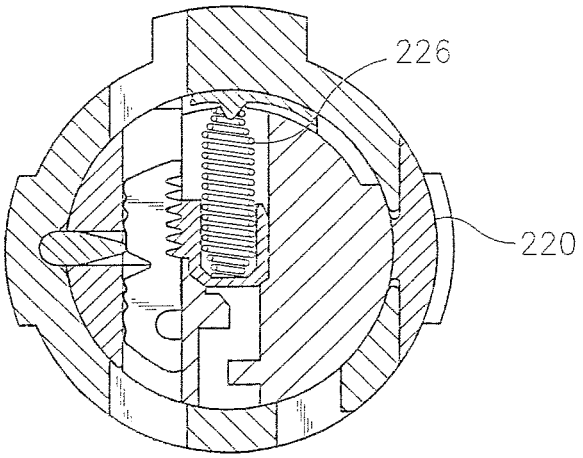
FIG. 25 PRIOR ART
FIG. 25 is a transverse section view taken through a prior art alternative embodiment.
Figure 26A:
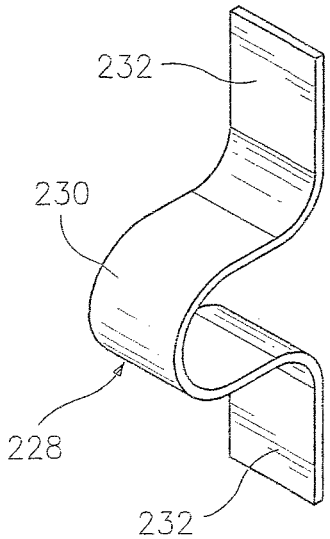
FIG. 26A PRIOR ART
FIGS. 26A-26B are views of an alternative embodiment of the prior art spring catch.
Figure 26B:
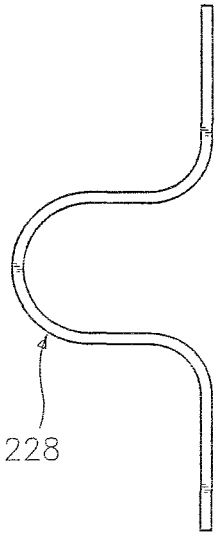
FIG. 26B PRIOR ART
Figure 31:
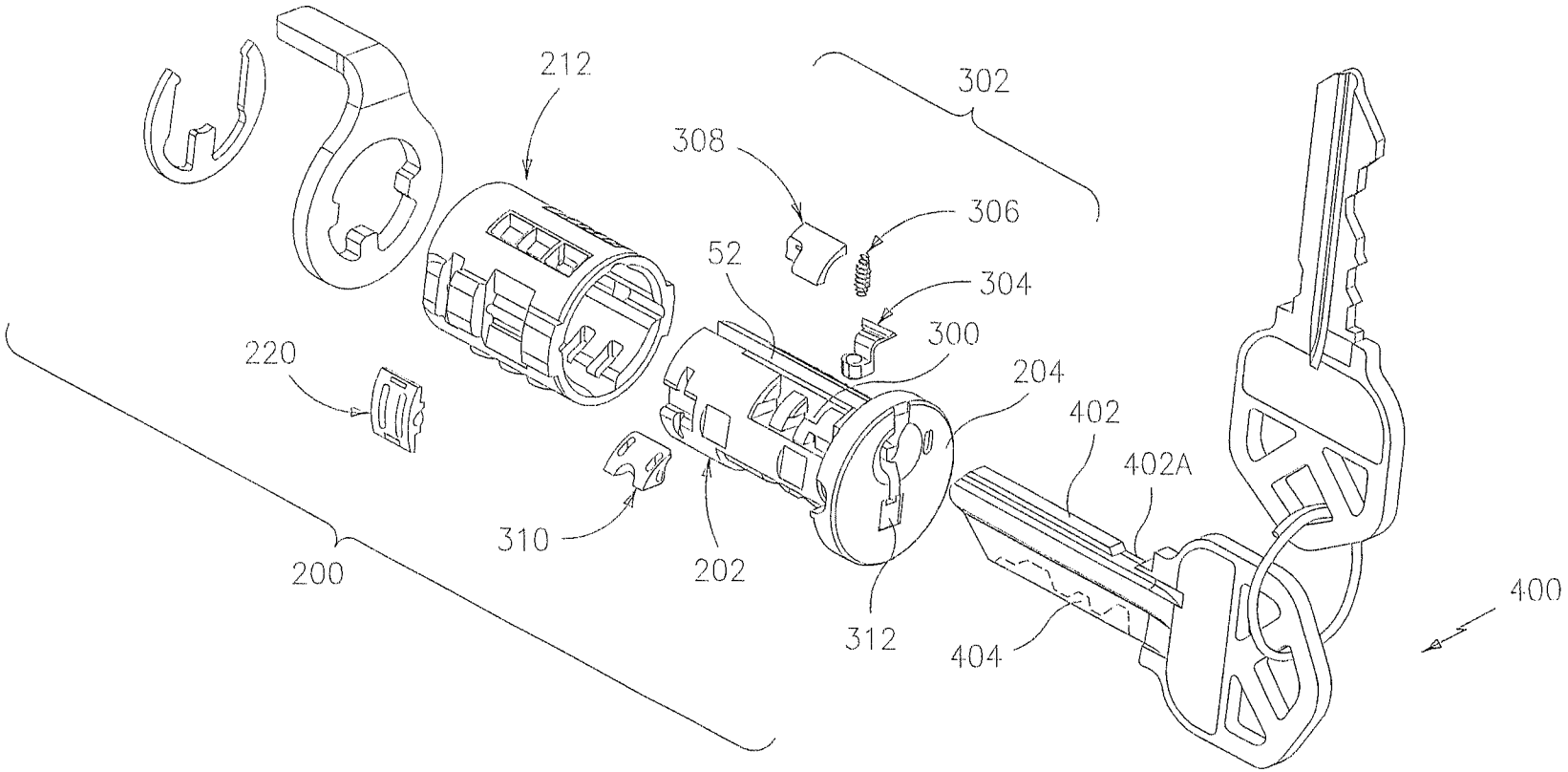
FIG. 31 is an exploded underside perspective view of the plug assembly illustrating a rekeying feature located to receive a lock assembly.

Referring to FIG. 31, the underside of the plug body 202 illustrates the rekeying feature 300 located generally adjacent to the keyway opening 52 and generally opposite the plurality of spring-loaded pins 244 (FIG. 23). It should be understood that various pin assemblies may be utilized herewith.

Figure 32:
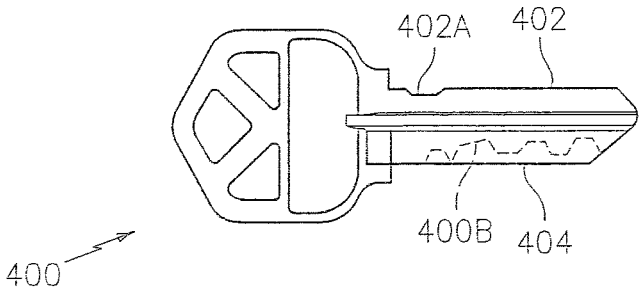
FIG. 32 is a side view of a key with slot opposite a key cut side to receive the lock assembly.
Figure 33A:
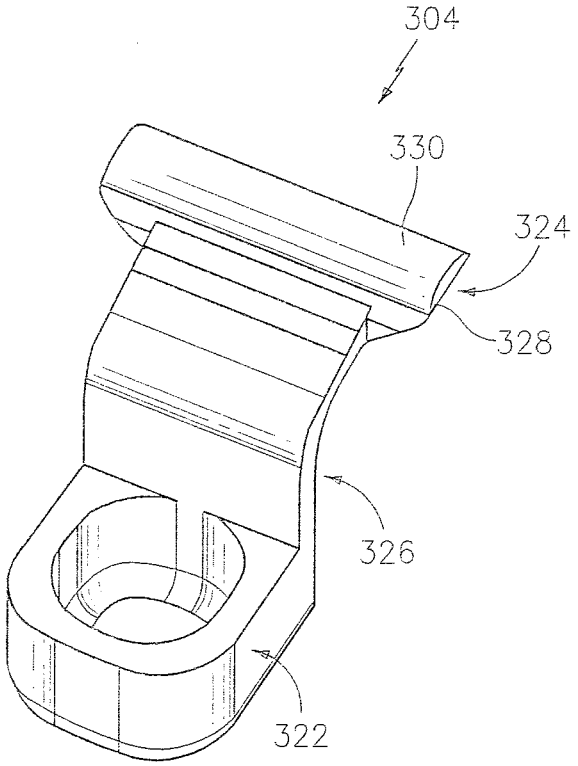
FIGS. 33A-33D are views of a holding bar of the lock assembly.
Figure 33B:
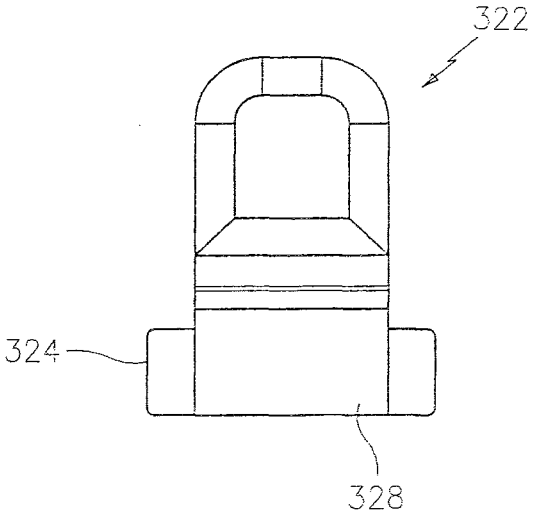
Figure 33C:
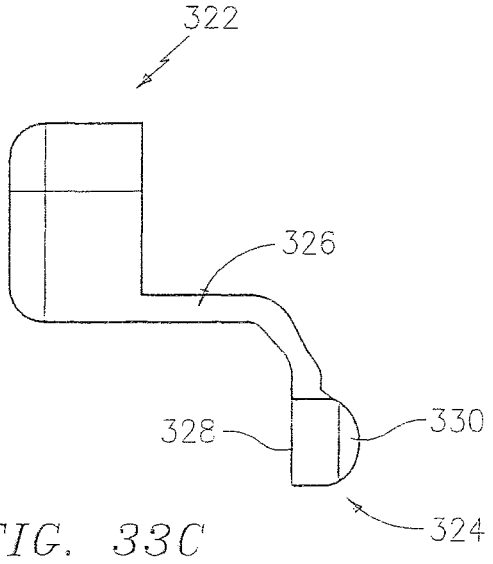
Figure 33D:
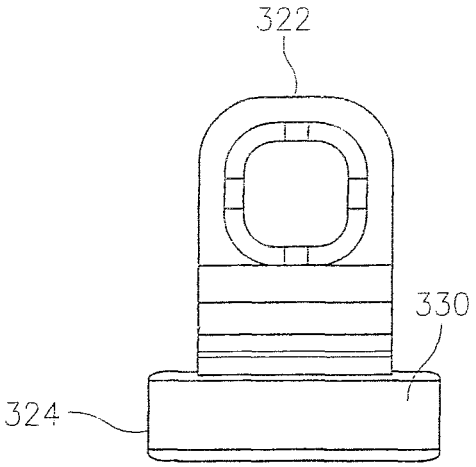
Figure 34:
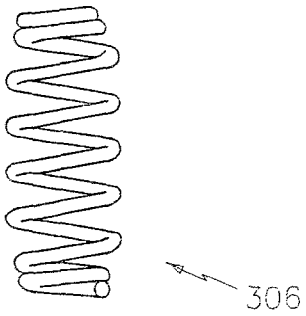
FIG. 34 is a view of a spring of the lock assembly.
Figure 35A:
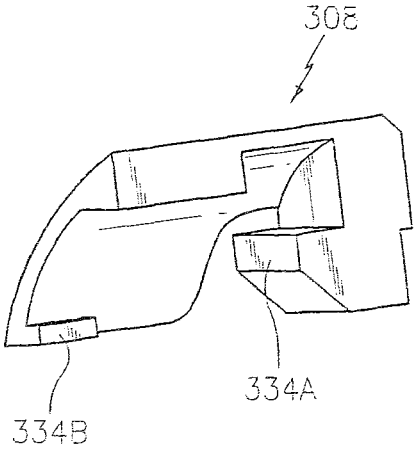
FIGS. 35A-35E are views of a holding bar cover of the lock assembly.
Figure 35B:
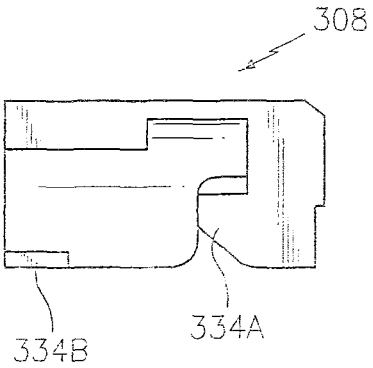
Figure 35C:
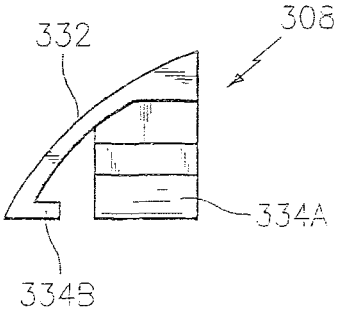
Figure 35D:
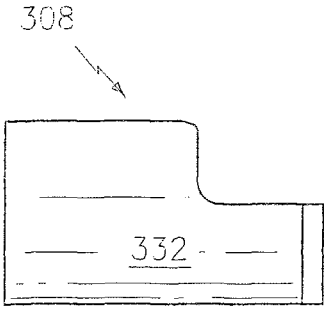
Figure 35E:
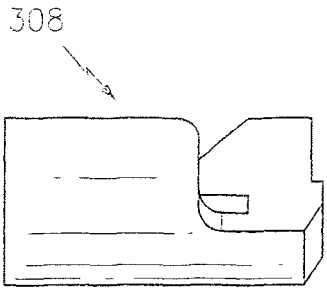

A key 400 includes a slot 402A located along a side 402 opposite the key cut side 404 of the key 400 which may include a multiple, typically five, slots 400B (also illustrated in FIG. 32).

Figure 36A:
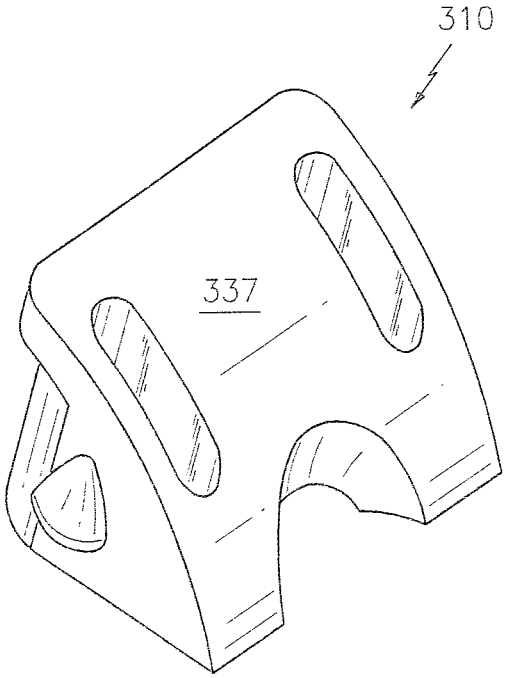
FIGS. 36A-36B are views of a stop of the lock assembly.
Figure 36B:
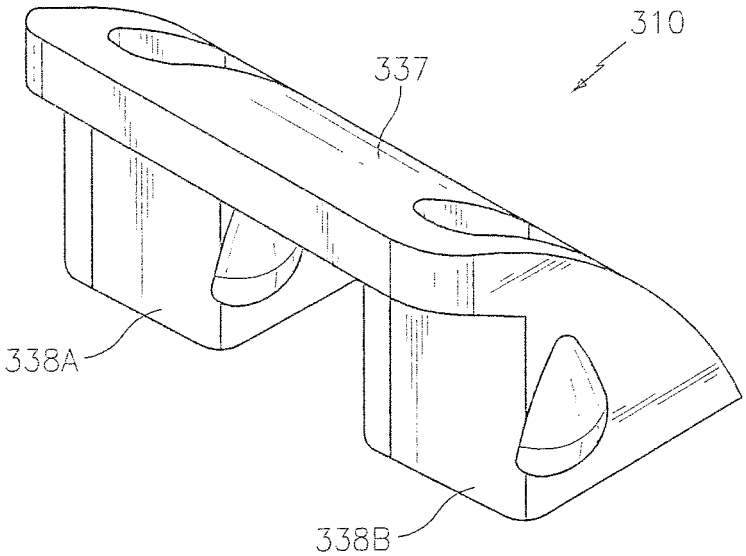

The rekeying feature 300 is located to receive a lock assembly 302 which includes a holding bar 304 (FIGS. 33A-33D), a spring 306 (FIG. 34), a holding bar cover 308 (FIGS. 35A-35E) and a stop 310 (FIGS. 36A and 36B). The holding bar 304, the spring 306, the holding bar cover 308 and the stop 310 are fit within the rekeying feature 300 to prevent rekeying unless the key 400 is fully inserted within the keyway opening 52 so that the key 400 is in contact with a keystop 312 and all of the slots 400B of the new valid key 400 are engaged with the associated pins 244 prior to the new valid key being rotated clockwise back to the home position as in the above described non-limiting embodiments.

Referring to FIGS. 33A-33D, the holding bar 304 generally includes a spring cup 322 on an opposite side of a key engagement member 324 relative an arm 326. The spring cup 322 is sized to receive one end section of the spring 306. The key engagement member 324 generally includes a relatively flat section 328 which faces the keyway opening 52 and a raised section 330 opposite thereto.

Referring to FIGS. 35A-35E, the holding bar cover 308 includes an arcuate surface 332 which generally matches an outer contour of the plug body 202. The internal surface of the arcuate surface 332 defines a first barb 334A and a second barb 334B. The first barb 334A is generally transverse to the arcuate surface 332 and the second barb 334B is transverse to the first barb 334A such that the first barb 334A extends generally perpendicular to the second barb 334B.

Referring to FIGS. 36A and 36B, the stop 310 is generally triangular in shape and includes an arcuate surface 337 which generally matches an outer contour of the plug body 202. The stop 310 further includes legs 338A. 338B which is sized to straddle the second support 318B.

Figure 37:
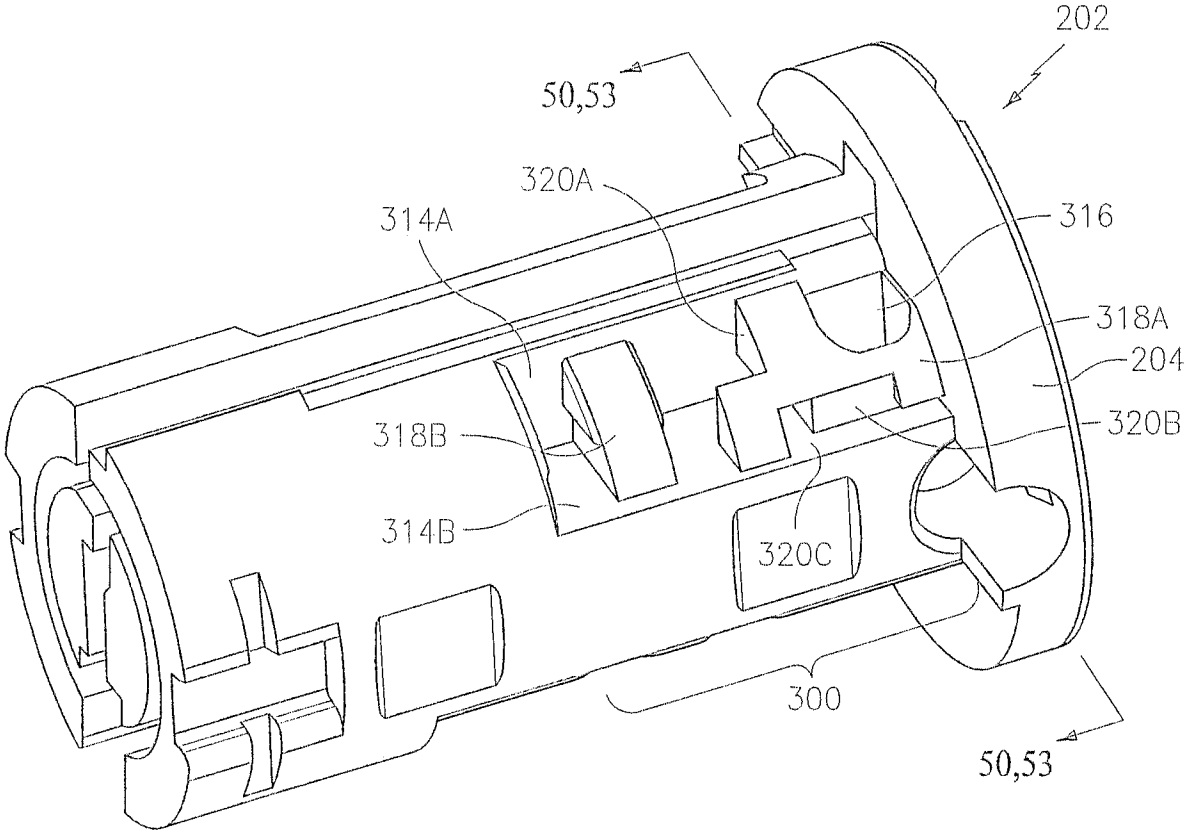
FIG. 37 is a perspective view of the plug body illustrating a rekeying feature located to receive a lock assembly.

Referring to FIG. 37, the rekeying feature 300 includes a first wall 314A and a second wall 314B in a perpendicular arrangement. An aperture 316 is defined in a first support 318A. A second support 318B is defined between the first and second wall 314A, 314B aft of the first support 318A relative the plug face 204. The first support 318A defines a first recess 320A and a second recess 320B. The first recess 320A is generally along the first wall 314A and the second recess 320B is generally along the second wall 314B. The first recess 320A intersect with the second recess 320B at area 320C.

Figure 39:
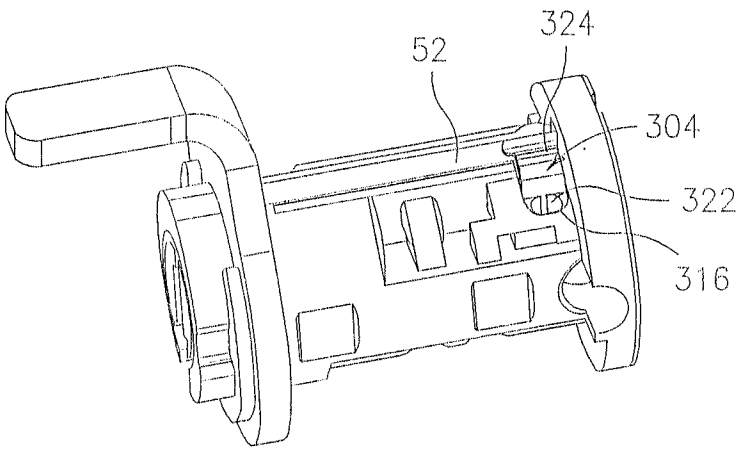
FIGS. 38-43 are perspective views illustrating the lock assembly being assembled into the rekeying feature.
Figure 38:
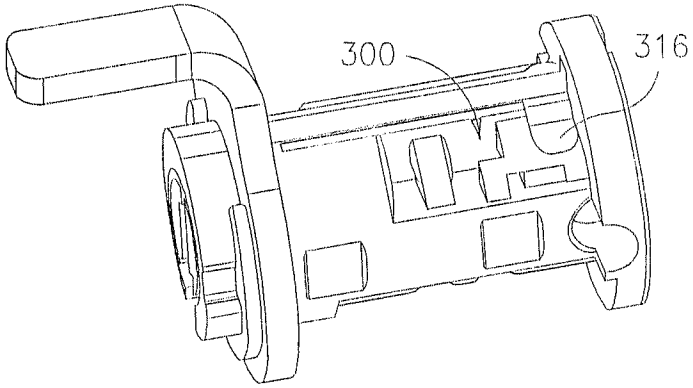
Figure 40:
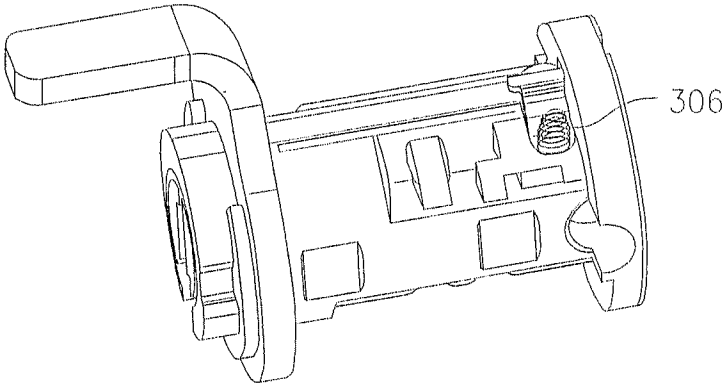

Referring to FIG. 38, the holding bar 304 is placed in the rekeying feature 300 such that the spring cup 322 rests within the aperture 316 (FIG. 39) while the key engagement member 324 is located within the keyway opening 52. The spring 306 is inserted into the spring cup 322 (FIG. 40).

Figure 41:
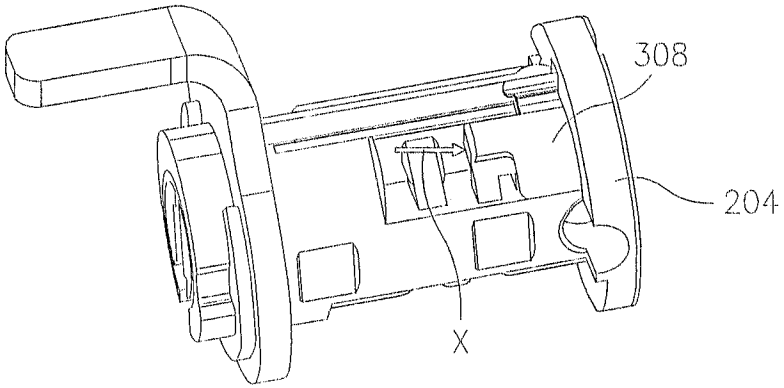
Figure 42:
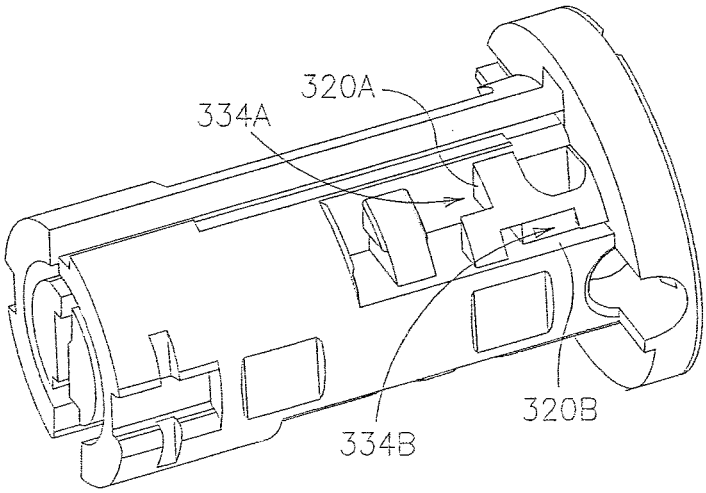

Referring to FIG. 41, the holding bar cover 308 is placed over the spring 306 set back from the plug face 204 such that the first barb 334A is aft of the first recess 320A and the second barb 334 B is within the second recess 320B (FIG. 42). The holding bar cover 308 is then moved forward toward the plug face 204 (illustrated by arrow X) such that the first barb 334A engages the first recess 320A and the second barb 33411 engages the second recess 320B. The holding bar cover 308 is thereby locked in the rekeying feature 300.

Figure 43:
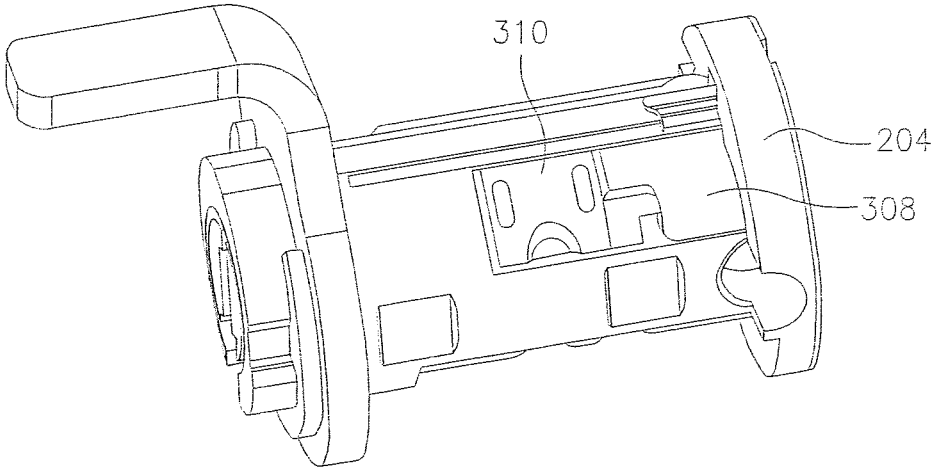

Referring to FIG. 43, the stop 310 is placed in the rekeying feature 300 such that the legs 338A, 338B of the stop 310 straddle the second support 318B and maintain the holding bar cover 308 in the forward locked position.

In operation, the rekeying feature 300 assures the key is properly inserted to avoid a blown cylinder.

Figure 44:
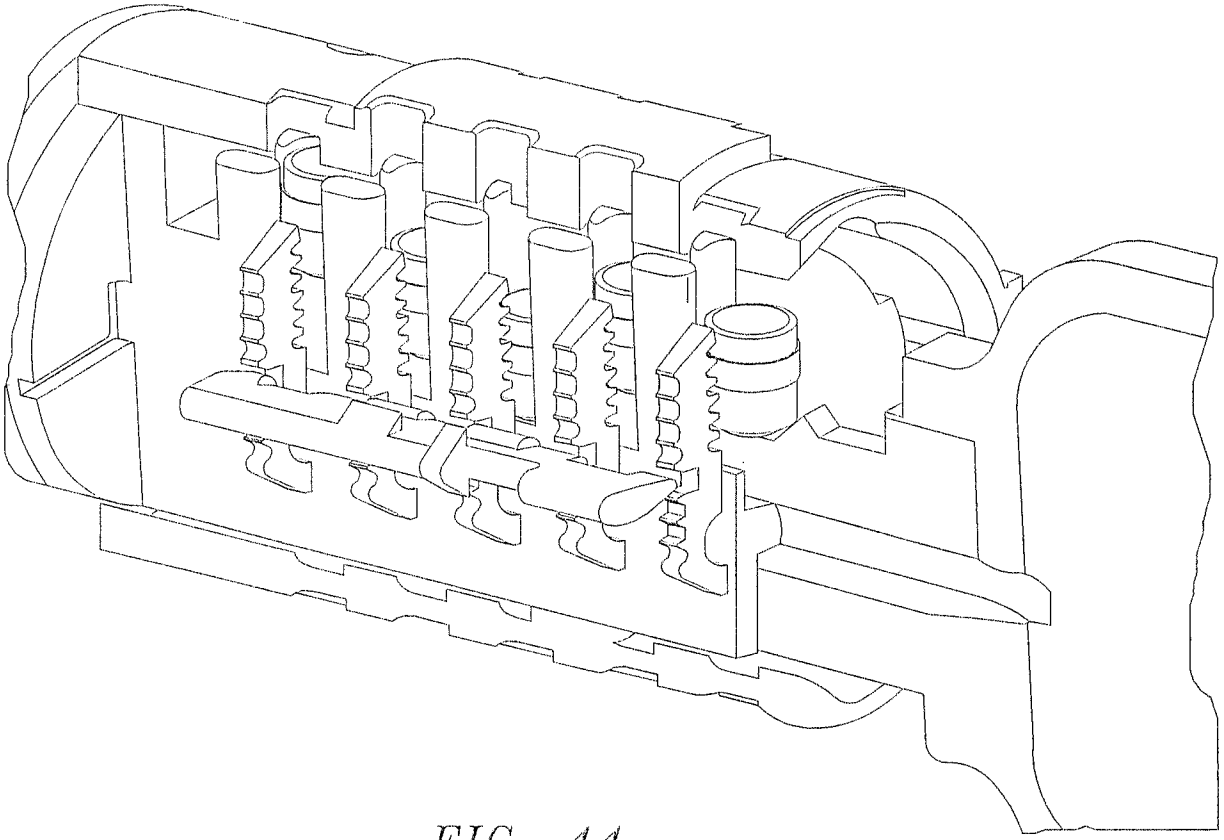
FIGS. 44-49 are perspective views illustrating rekeying of the lock assembly.
Figure 45:
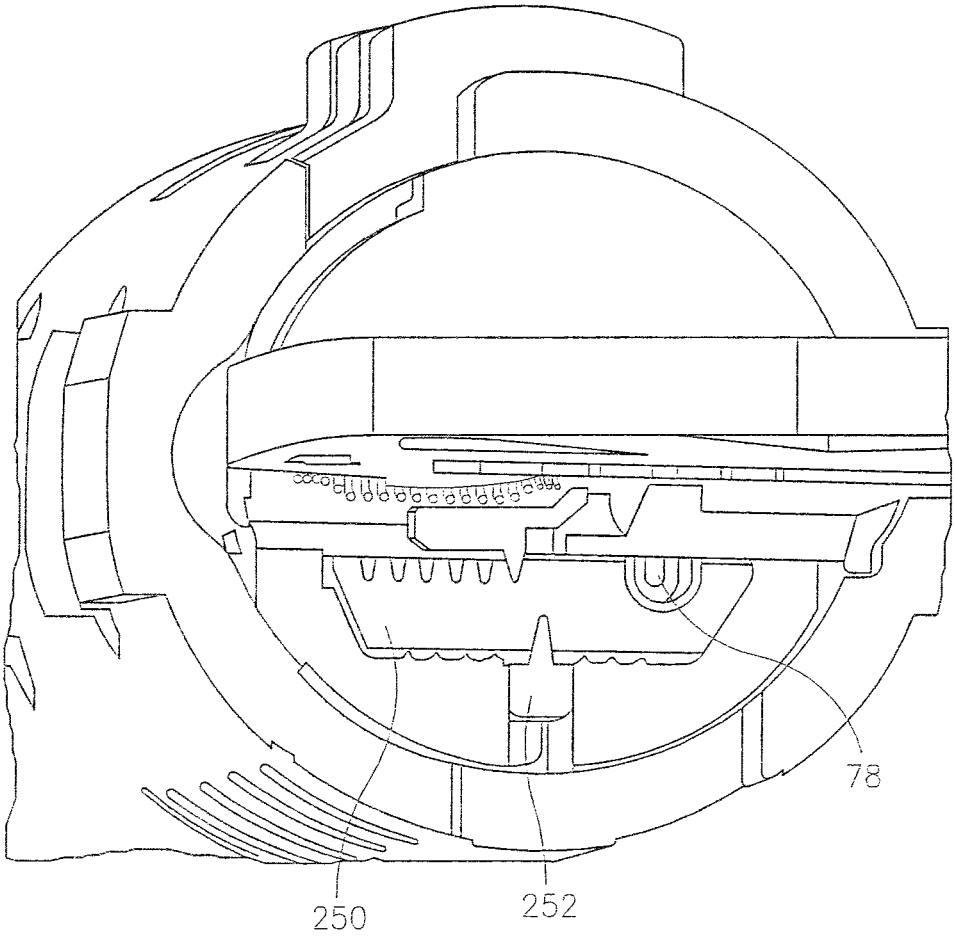
Figure 46:
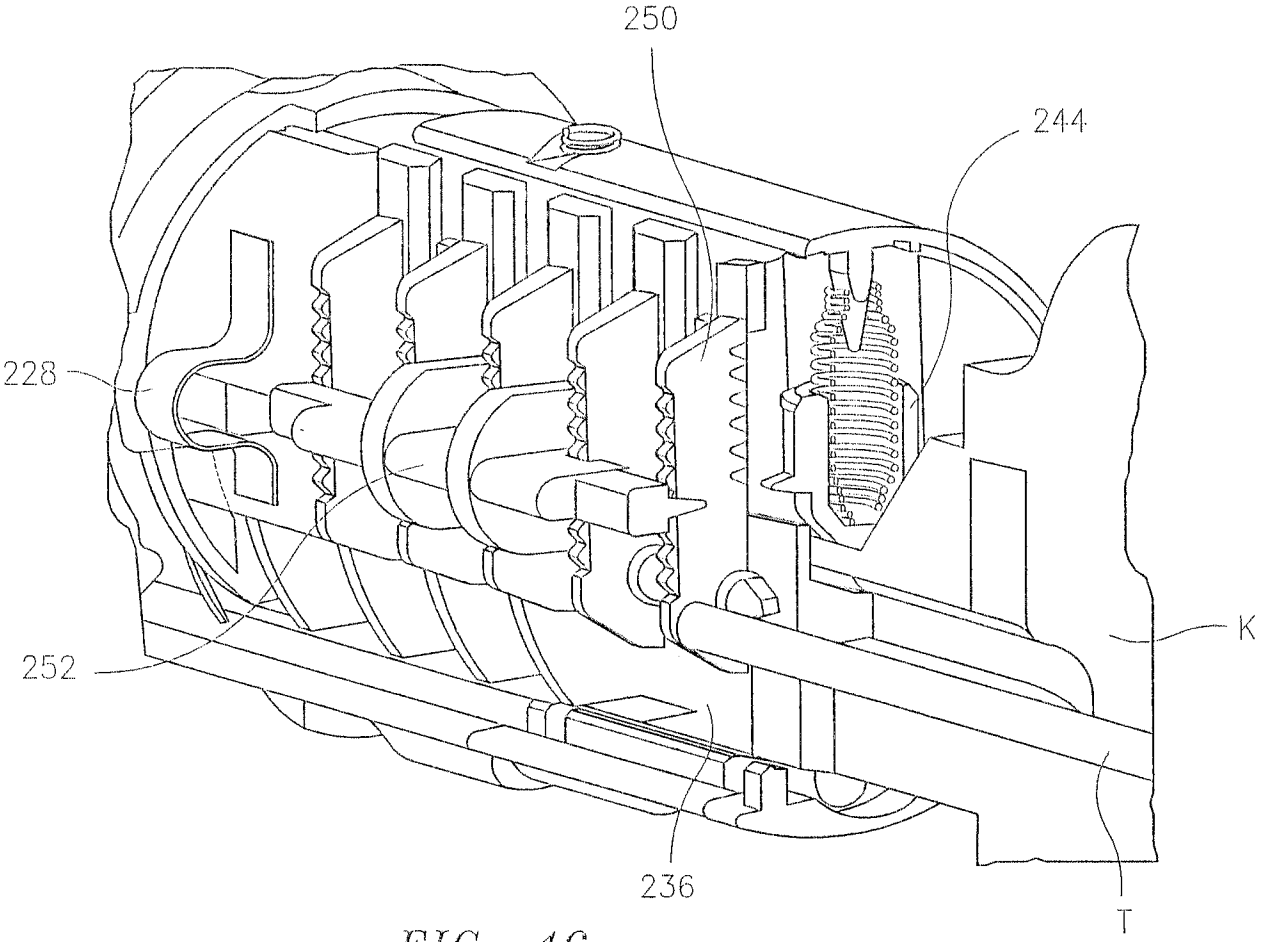

To rekey the lock cylinder 200, the current valid key K is inserted into the keyway opening 52, as illustrated in FIG. 44 and rotated approximately 90° counterclockwise from the home position (FIG. 45). A pointed tool T is inserted into the tool opening 54 (FIG. 46) and pushed against the carrier 236 to move the carrier 236 parallel to the longitudinal axis of the lock cylinder 200 until the spring catch 228 moves into a first detent recess 30 as described above. The pointed tool T is then removed such that the cylinder is in a learn mode (FIG. 47).

Figure 47:
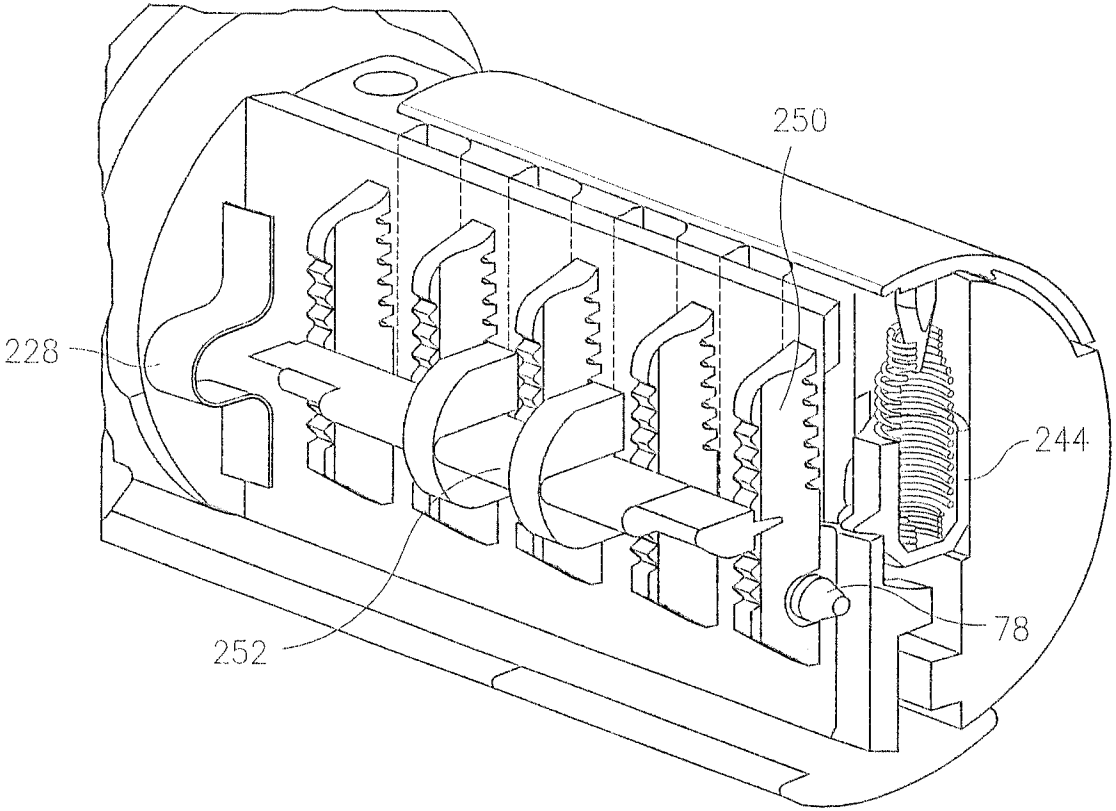
Figure 48:
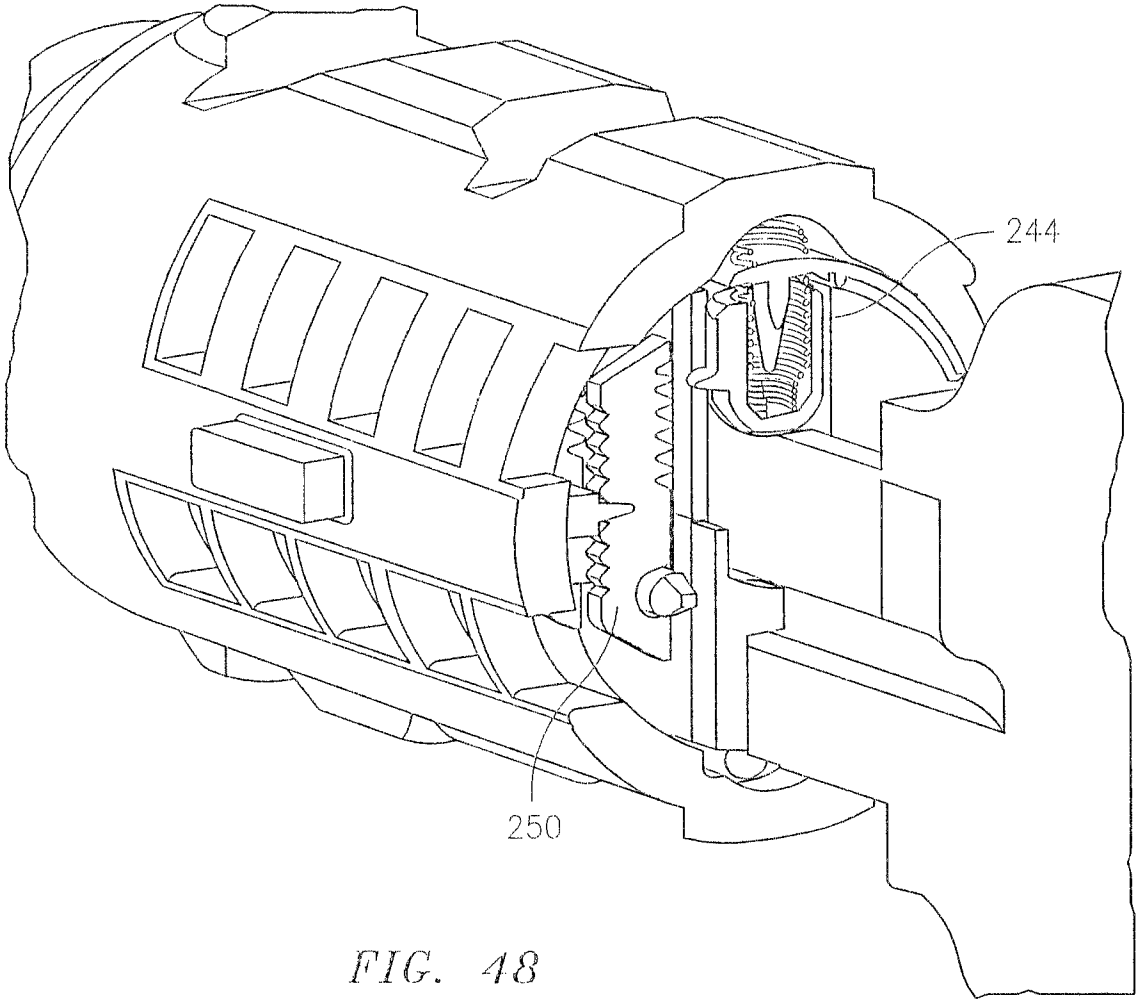
Figure 49:
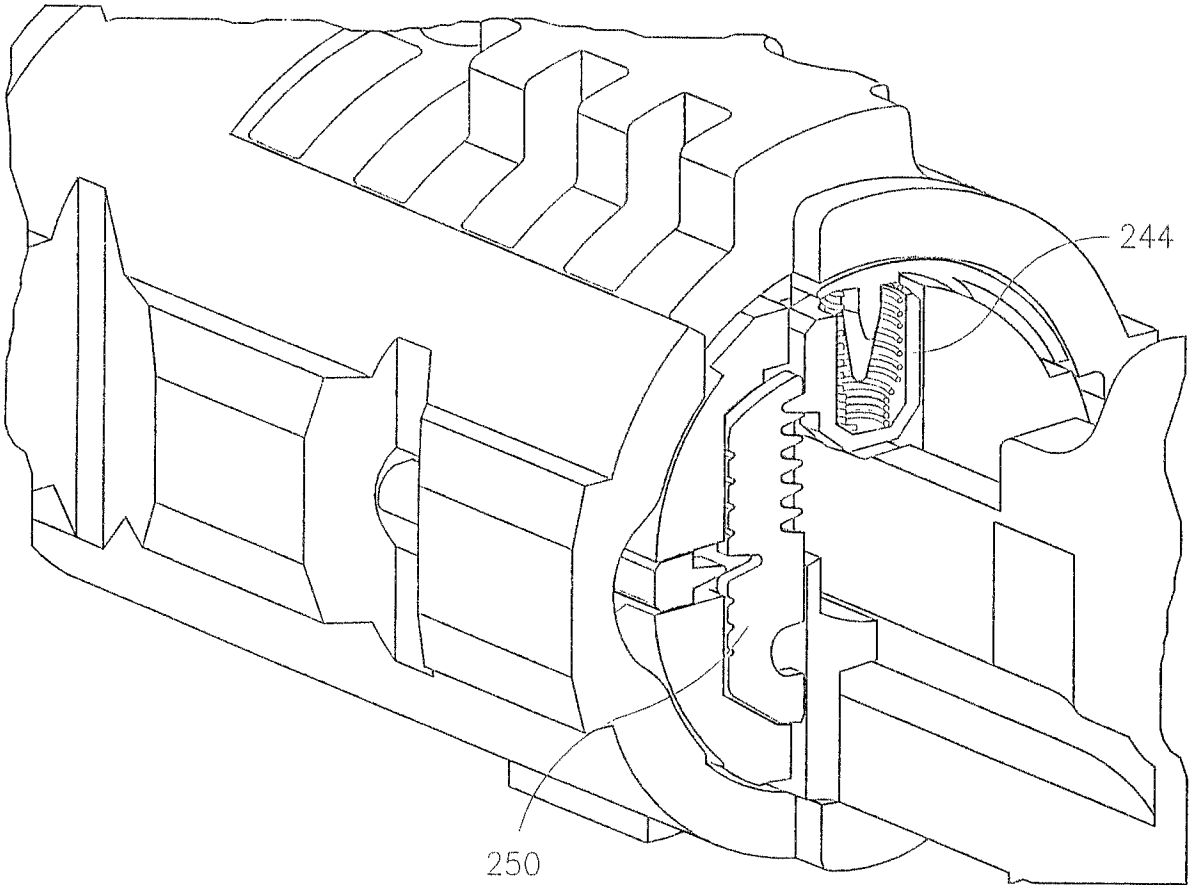

With the spring catch 228 disposed in the first detent recess 30, the racks 250 are disengaged from the pins 244 as illustrated in FIG. 47. The key K is removed and the second key 400 with a different bit arrangement is inserted and rotated clockwise to release the spring catch 228 (FIGS. 48-49).

Figure 50:
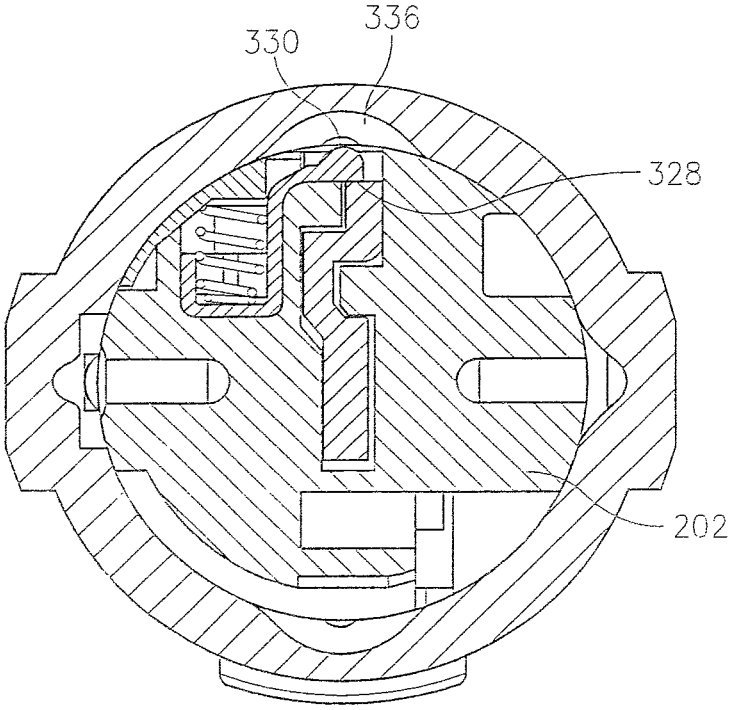
FIG. 50 is a sectional view of the plug assembly with a key fully inserted into the keyway opening.
Figure 51:
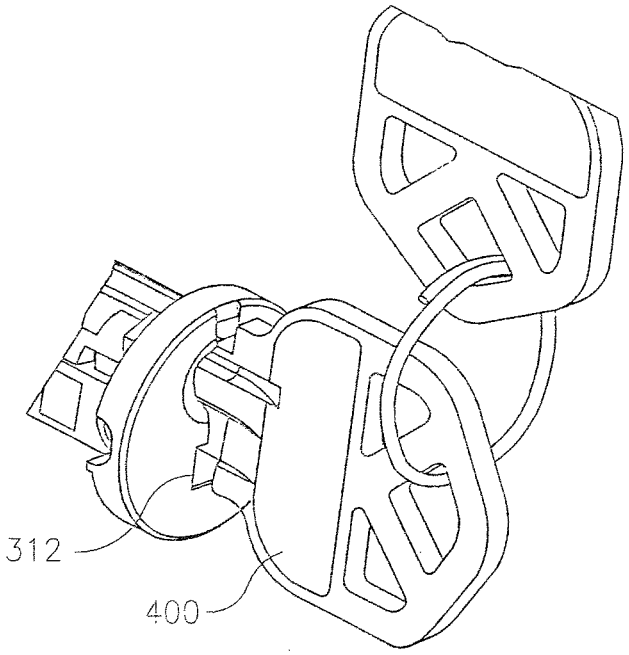
FIG. 51 is a perspective view of the plug assembly with a key fully inserted into the keyway opening.
Figure 53:
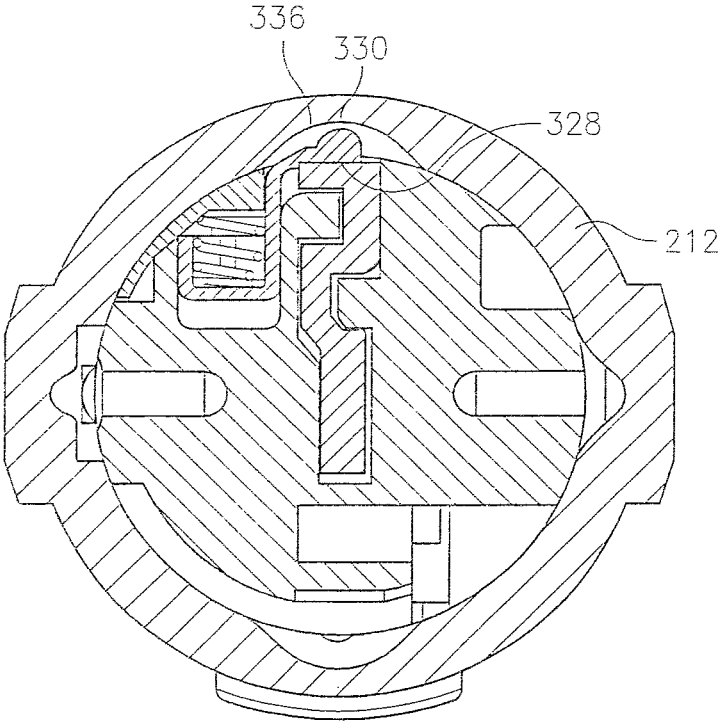
FIG. 53 is a sectional view of the plug assembly with a key not fully inserted into the keyway opening.

Referring to FIG. 50, when the key 400 is fully inserted into the keyway opening 52 such that the key 400 fully contacts the keystop 312 (FIG. 51) and the slot 400B is aligned with the key engagement member 324, the raised section 330 is retracted from a detent recess 336. Notably, the recess 336 is set back from the end of the cylinder body 212 as illustrated in the sectional view of FIGS. 50 and 53. In this condition, the plug body 202 can be turned within the cylinder 212 such that the second key 400 inserted in the keyway opening 52 may be properly rotated clockwise back to the home position.

Figure 52:
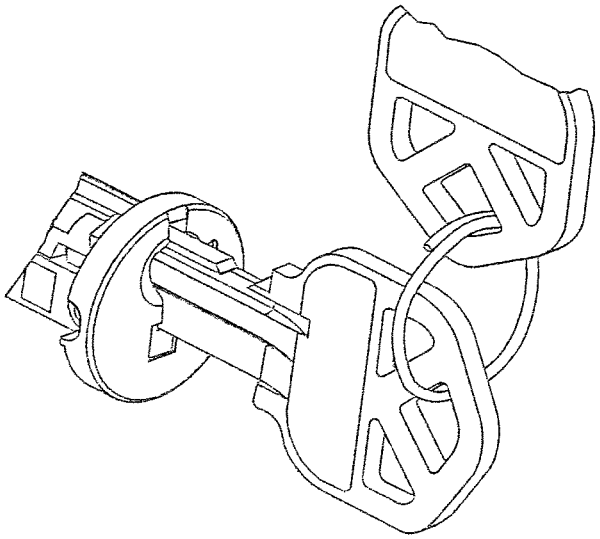
FIG. 52 is a perspective view of the plug assembly with a key not fully inserted into the keyway opening.

In contrast, should the second key 400 not be fully inserted into the keyway opening 52 (FIG. 51), the key engagement member 324 is supported on the key 400 and the raised section 330 is maintained into the detent recess 336 (FIG. 52) located within the interior surface of the lock cylinder body 212. In this condition, the plug body 202 cannot be rotated and the lock cylinder 200 cannot be rekeyed through the rekeying process discussed above because the key 400 is not fully and properly inserted. The condition known as "blown cylinder" is thereby prevented.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A rekeyable lock cylinder comprising:

a plug body with a keyway opening along a longitudinal axis and a multiple of channels transverse to said axis;

a rekeying feature adjacent to said keyway opening wherein said rekeying feature includes a first wall and a second wall in a perpendicular arrangement, said first wall parallel to said keyway opening; and, a first support and a second support, said first support forward of said second support relative to a plug face of said plug body and wherein said first support defines a first recess generally along said first wall and a second recess is generally along said second wall, said first recess at least partially intersects with said second recess.

2. The rekeyable lock cylinder as recited in claim 1, wherein said rekeying feature is generally opposite said multiple of channels.

3. The rekeyable lock cylinder as recited in claim 1, wherein said rekeying feature receives a lock assembly movable with respect to insertion of a key into said keyway opening, said lock assembly includes a holding bar with a key engagement member movable with respect to insertion of said key.

4. The rekeyable lock cylinder as recited in claim 1, wherein said rekeying feature receives a lock assembly movable with respect to insertion of a key, said lock assembly comprising:

a holding bar with a key engagement member movable with respect to insertion of said key, said holding bar includes a spring cup on an opposite side of said key engagement member relative an arm, said spring cup received within said first support;

a spring at least partially within said spring cup;

a holding bar cover engaged with said first support to retain said spring between said spring cup and said holding bar cover; and a stop adjacent to said holding bar cover, said stop engaged with said second support.

5. The rekeyable lock cylinder as recited in claim 4, wherein said key engagement member includes a relatively flat section which faces said keyway opening and a raised section opposite thereto.

6. A rekeyable lock cylinder comprising:

a cylinder body which defines a longitudinal axis;

a plug body positionable within said cylinder body, said plug body includes a keyway opening along said longitudinal axis;

a carrier disposed adjacent said plug body;

a plurality of pins disposed in said plug body; and a rekeying feature adjacent to said keyway opening wherein said rekeying feature receives a lock assembly movable with respect to insertion of a key, wherein said lock assembly includes a holding bar with a key engagement member movable with respect to insertion of said key wherein said key engagement member includes a relatively flat section which faces said keyway opening and a raised section opposite thereto, and wherein said raised section is engageable with a detent recess located within an interior surface of a cylinder wall of said lock cylinder body when said key is not fully inserted into said keyway opening.

7. The rekeyable lock cylinder as recited in claim 6, wherein said holding bar includes a spring cup on an opposite side of said key engagement member relative an arm.

8. The rekeyable lock cylinder as recited in claim 7, wherein said spring cup receives a spring, said spring retained by a holding bar cover engaged with said rekeying feature.

9. The rekeyable lock cylinder as recited in claim 8, further comprising a stop adjacent to said holding bar cover, said stop engaged with said rekeying feature.

10. A rekeyable lock cylinder comprising:

a cylinder which defines a longitudinal axis;

a plug body rotatable within said cylinder;

a multiple of pins movably mountable within said plug body transverse said longitudinal axis;

a multiple of biasing members to bias said respective multiple of pins toward a keyway opening;

a carrier mountable adjacent said plug body;

a multiple of racks slidably movable transverse to said longitudinal axis, said multiple of racks engaged with said multiple of pins in response to said carrier being at a first predetermined position, said carrier axially displaceable along said longitudinal axis to selectively disengage said multiple of racks from said multiple of pins in response to said carrier being at a second predetermined position; and a rekeying feature adjacent to the keyway opening wherein said rekeying feature includes a first wall and a second wall in a perpendicular arrangement, said first wall parallel to said keyway opening, a first support defines a first recess generally along said first wall and a second recess is generally along said second wall, said first recess at least partially intersects with said second recess.

11. The rekeyable lock cylinder as recited in claim 10, wherein said rekeying feature receives a lock assembly movable with respect to insertion of a key, said lock assembly comprising:

a holding bar with a key engagement member movable with respect to insertion of said key, said holding bar includes a spring cup on an opposite side of said key engagement member relative an arm, said spring cup received within said first support;

a spring at least partially within said spring cup;

a holding bar cover engaged with said first support to retain said spring between said spring cup and said holding bar cover; and a stop adjacent to said holding bar cover, said stop engaged with a second support.

12. A rekeyable lock cylinder comprising:

a plug body with a keyway opening extending along a longitudinal axis within said plug body and a channel transverse to said axis;

a rekeying feature adjacent to and extending into said keyway opening wherein said rekeying feature includes a portion that moves radially inwardly and outwardly relative to said longitudinal axis in response to insertion of a key, said portion not interfering with locking or unlocking operations of said lock cylinder if a key is not fully inserted if said plug body is in a first position and said portion interfering with rekeying of said lock cylinder by extending outside of said plug body if a new key is not fully inserted in said keyway opening if said plug body is in a second position; and wherein said rekeying feature includes a first wall and a second wall in a perpendicular arrangement, said first wall parallel to said keyway opening, a first support defines a first recess generally along said first wall and a second recess is generally along said second wall, said first recess at least partially intersects with said second recess.

13. The rekeyable lock cylinder of claim 12 further comprising:

a recess in which said portion that extends outside of said plug body is received if a new key is not fully inserted in said keyway opening if said plug body is in a second position, said recess and said portion cooperating to block rotation of said plug body.

14. The rekeyable lock cylinder of claim 12 wherein said portion contacts a contour of said new key as said new key is inserted in said keyway opening.

15. The rekeyable lock cylinder of claim 14 wherein said portion contacts said contour on a side of said new key opposite a cut side thereof.

16. The rekeyable lock cylinder of claim 14 wherein said portion is biased to be in contact with said new key by a spring.

17. The rekeyable lock cylinder of claim 16 wherein an axis of said spring is parallel to said keyway opening.

* * * * *